US010714233B2

(12) United States Patent
Uchiyama et al.

(10) Patent No.: US 10,714,233 B2
(45) **Date of Patent: *Jul. 14, 2020**

(54) ALUMINUM ELECTRICAL WIRE AND METHOD FOR MANUFACTURING ALUMINUM ELECTRICAL WIRE

(71) Applicants: FURUKAWA ELECTRIC CO., LTD., Tokyo (JP); FURUKAWA AUTOMOTIVE SYSTEMS INC., Inukami-gun (JP)

(72) Inventors: Yasuharu Uchiyama, Tokyo (JP); Akihiro Sakaki, Tokyo (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/671,490

(22) Filed: Nov. 1, 2019

(65) Prior Publication Data

US 2020/0066423 A1 Feb. 27, 2020

Related U.S. Application Data

(63) Continuation of application No. 16/017,321, filed on Jun. 25, 2018, now Pat. No. 10,468,154, which is a (Continued)

(30) Foreign Application Priority Data

Dec. 25, 2015 (JP) ..... 2015-253019

(51) Int. Cl.
*H01B 7/00* (2006.01)
*H01B 7/02* (2006.01)
(Continued)

(52) U.S. Cl.
CPC ..... *H01B 7/02* (2013.01); *C22C 21/00* (2013.01); *C22F 1/04* (2013.01); *H01B 1/023* (2013.01);
(Continued)

(58) Field of Classification Search
USPC ..... 174/36, 125.1, 125.2, 110 R
See application file for complete search history.

(56) References Cited

U.S. PATENT DOCUMENTS

2010/0038112 A1* 2/2010 Grether ..... D07B 1/02 174/128.1
2011/0036614 A1* 2/2011 Otsuka ..... C22C 21/00 174/113 R
2013/0333916 A1* 12/2013 Matsuno ..... H01B 7/0009 174/110 R

FOREIGN PATENT DOCUMENTS

CN 200969242 Y 10/2007
CN 101828240 A 9/2010
(Continued)

OTHER PUBLICATIONS

International Search Report dated Mar. 21, 2017 in PCT/JP 2016/088796 filed Dec. 26, 2016 (with English Translation).
(Continued)

*Primary Examiner* — William H. Mayo, III
(74) *Attorney, Agent, or Firm* — Oblon, McClelland, Maier & Neustadt, L.L.P.

(57) ABSTRACT

An aluminum electrical wire includes a conductor including aluminum-based core wires, and an insulating resin covering covering the conductor and having a thickness deviation of not less than 70%. The aluminum-based core wires contain 99 mass % of aluminum, and the conductor is constructed by concentrically twisting 19 or 37 of the aluminum-based core wires at the same pitch in a non-compressed state such that the aluminum electrical wire has a current capacity that is
(Continued)

substantially the same as a current capacity of a copper electrical wire having a diameter that is substantially the same as a diameter of the aluminum electrical wire.

20 Claims, 12 Drawing Sheets

Related U.S. Application Data continuation of application No. PCT/JP2016/088796, filed on Dec. 26, 2016.

(51) Int. Cl.

| | |
|---|---|
| ***C22C 21/00*** | (2006.01) |
| ***C22F 1/04*** | (2006.01) |
| ***H01B 1/02*** | (2006.01) |
| ***H01B 3/44*** | (2006.01) |
| ***H01B 13/06*** | (2006.01) |

(52) U.S. Cl.

CPC ..... *H01B 3/443* (2013.01); *H01B 7/0009* (2013.01); *H01B 13/06* (2013.01)

(56) References Cited

FOREIGN PATENT DOCUMENTS

| | | | | |
|---|---|---|---|---|
| CN | 103403812 | A | | 11/2013 | |
| EP | 1 852 875 | A1 | | 11/2007 | |
| JP | 2011-108492 | | | 6/2011 | |
| JP | 2011-108492 | A | * | 6/2011 | ..... H01B 13/24 |
| JP | 2012-500452 | | | 1/2012 | |
| JP | 2012-182000 | | | 9/2012 | |
| JP | 5304608 | B2 | | 10/2013 | |
| WO | WO 2009/054457 | A1 | | 4/2009 | |
| WO | WO 2012/043873 | A1 | | 4/2012 | |
| WO | WO 2012/057348 | A1 | | 5/2012 | |

OTHER PUBLICATIONS

Combined Chinese Office Action and Search Report dated Mar. 29, 2019 in Chinese Patent Application No. 201680075624.7 (with English translation), citing documents AP, AQ and AR therein, 15 pages.

Extended European Search Report dated Aug. 9, 2019 in European Application No. 16879061.6, filed Dec. 26, 2016, citing documents AS-AU therein, 8 pages.

Japanese Office Action dated Feb. 21, 2020 in Patent Application No. 2017-558341 (with English translation), 6 pages.

Combined Chinese Office Action and Search Report dated Dec. 18, 2019 in Chinese Patent Application No. 201680075624.7 (with English translation), citing document AO therein, 20 pages.

Office Action dated Apr. 8, 2020 in European Application No. 16879061.6, filed Dec. 26, 2016, 3 pages.

Office Action dated Jun. 2, 2020 in Japanese Patent Application No. 2017-558341, with English-language translation, 5 pages; documents cited therein have been submittd on Nov. 1, 2019.

* cited by examiner 1, 1A: ALUMINUM ELECTRICAL WIRE
10, 10A: ALUMINUM CONDUCTOR
20, 20A: ALUMINUM-BASED CORE WIRE
30: INSULATING RESIN COVERING 1, 1A: ALUMINUM ELECTRICAL WIRE
10, 10A: ALUMINUM CONDUCTOR
20, 20A: ALUMINUM-BASED CORE WIRE
30: INSULATING RESIN COVERING

ALUMINUM ELECTRICAL WIRE AND METHOD FOR MANUFACTURING ALUMINUM ELECTRICAL WIRE

CROSS-REFERENCE TO RELATED APPLICATIONS

The present application is a Continuation of U.S. patent application Ser. No. 16/017,321, filed Jun. 25, 2018, the entire contents of which are incorporated herein by reference. U.S. patent application Ser. No. 16/017,321 is a Bypass Continuation of International Application No. PCT/JP2016/088796, filed Dec. 26, 2016, which is based upon and claims the benefit of priority to Japanese Applications No. 2015-253019, filed Dec. 25, 2015. The present application claims the benefit of priority to Japanese Patent Application No. 2015-253019, International Application No. PCT/JP2016/088796, and U.S. patent application Ser. No. 16/017,321.

TECHNICAL FIELD

The present invention relates to an aluminum electrical wire constructed by covering an aluminum-based conductor with an insulating resin covering, and a method for manufacturing an aluminum electrical wire.

BACKGROUND ART

For example, numerous insulated electrical wires are installed in automobiles, and lighter-weight insulated electrical wires have been sought to respond to the demand for lighter-weight vehicles.

Typical insulated electrical wire is constituted of a conductor in which electrically conductive core wires (filaments) are bundled, and an insulating resin covering which covers the conductor. Up to now, conductors constituted of core wires made of copper or copper alloy (called "copper conductors" hereinafter) having excellent electrical conductivity have been generally used.

In contrast, to respond to the demand for lighter weight as mentioned above, an aluminum electrical wire that uses a conductor in which core wires made of aluminum or aluminum alloy (called "aluminum-based core wires" hereinafter) are bundled is proposed in Patent Document 1, and this aluminum electrical wire is described as being lightweight compared to insulated electrical wire that uses a copper conductor of the same diameter.

However, the electrical conductivity of an aluminum conductor is lower than that of a copper conductor (approximately 60%), and the cross-sectional area of an aluminum conductor must be greater than the cross-sectional area of a copper conductor in order to assure electrical conductivity similar to that of an insulated electrical wire constituted of a copper conductor.

In this way, in aluminum electrical wires having an aluminum conductor that assures electrical conductivity similar to that of a copper conductor, the outer diameter of the aluminum electrical wires is larger because the cross-sectional area of an aluminum conductor is larger than that of a copper conductor, that is, the cross-sectional diameter is larger. Specifically, by setting the thickness of an aluminum conductor to from approximately 1.5 to 1.7 times the thickness of a copper conductor, an electrical wire having similar current capacity and similar electrical conductivity can be obtained.

When the outer diameter of the electrical wire is large, the connecting portion between the electrical wire and the terminal such as a crimping portion on the crimping terminal to which the insulated electrical wire is connected becomes large, and there is the risk that the terminal can no longer be inserted in the cavity (terminal insertion hole) in the connector housing of the connector constructed by mounting the terminal.

CITATION LIST

Patent Literature

Patent Document 1: |JP 2014-74229 A

SUMMARY OF INVENTION

Technical Problem

In light of the above problem, an object of the present invention is to provide an aluminum electrical wire having electrical conductivity similar to that of an insulated electrical wire having a copper conductor without an increase in the electrical wire outer diameter.

Solution to Problem

The present invention is an aluminum electrical wire wherein a conductor including a plurality of aluminum-based core wires containing not less than 99 mass % of aluminum is covered with an insulating resin covering. The conductor is constructed by concentrically twisting 19 or 37 of the aluminum-based core wires in a non-compressed state and at the same pitch. The thickness deviation of the insulating resin covering is not less than 70%.

According to the present invention, an aluminum electrical wire having electrical conductivity similar to that of an insulated electrical wire including a copper conductor can be constructed without an increase in wire outer diameter.

Specifically, in an aluminum electrical wire wherein a conductor including a plurality of aluminum-based core wires containing not less than 99 mass % of aluminum is covered with an insulating resin covering, by constructing the conductor by concentrically twisting the aluminum-based core wires in a non-compressed state and at the same pitch, flexibility of the aluminum-based core wires is high, resulting in the conductor having excellent flexibility, and a conductor in which aluminum-based core wires are aligned in an orderly manner in cross-section without the aluminum-based core wires unraveling even when covered with insulating resin can be constructed.

On the other hand, in the case of, for example, a twisted wire conductor in which core wires are twisted by a twisting method such as bunch stranding or rope stranding (composite stranding), although the electrical wire outer diameter is not large because the conductor is covered with an insulating resin covering that is thin relative to the conductor outer diameter, there is the possibility that unraveled core wires will jam into the insulating resin covering, and the insulating resin covering will deviate in thickness and localized portions of the insulating resin covering will become thin, and the performance required in an insulating resin covering such as insulating properties and strength cannot be assured.

In contrast, in a conductor constructed by concentrically twisting aluminum-based core wires as described above, the required thickness can be reliably assured even with a thin insulating resin covering because the aluminum-based core wires are aligned in an orderly manner in cross-section.

Furthermore, by constructing the conductor with 19 or 37 of the above concentrically twisted aluminum-based core wires, an aluminum electrical wire having a conductor constructed by a twisting method suitable for a desired cross-sectional area can be constructed.

Additionally, the conductor is disposed near the center in cross-section because the thickness deviation, which is the ratio of thin locations (called "insulator minimum thickness" hereinafter) relative to thick locations (called "insulator maximum thickness" hereinafter) of the conductor and insulating resin covering in the cross-section perpendicular to the length direction, is not less than 70%. As a result, the difference between the insulator minimum thickness and the insulator maximum thickness can be small.

Specifically, the insulating resin covering, which covers the conductor such that the insulator minimum thickness is of a predetermined thickness, can be made thin in locations of insulator maximum thickness. Thus, the outer diameter of the aluminum electrical wire can be small.

As a mode of the present invention, the aluminum-based core wires constituting the conductor may be disposed in a cross-sectionally regular hexagonal form.

According to the present invention, because the aluminum-based core wires constituting the conductor can be aligned in a more orderly manner in cross-section and the cross-sectional shape of the conductor can be made stable across the length direction, the thickness of the insulating resin covering can be substantially identical on average and the required thickness can be reliably assured even with a thin insulating resin covering.

Furthermore, as a mode of the present invention, the core wire diameters of the 19 or 37 aluminum-based core wires constituting the conductor may be the same.

According to the present invention, because the conductor is formed of one type of aluminum-based core wire, error in the outer diameter of the conductor can be reduced. Additionally, because there is no need to manufacture a plurality of types of aluminum-based core wire, the manufacturing process can be simplified and manufacturing costs can be reduced.

Furthermore, when the aluminum-based core wires constituting the conductor are disposed in a cross-sectionally regular hexagonal form, core wires of the same diameter can be more stably disposed because the aluminum-based core wires disposed on the outer layer can fit between the aluminum-based core wires disposed on the inner layer. Specifically, the core wires can be aligned in a more orderly manner.

As a mode of the present invention, the cross-sectional area of the conductor may be not less than 2.5 $mm^2$ and less than 17 $mm^2$.

According to the present invention, because the cross-sectional area of the conductor is not less than 2.5 $mm^2$ and less than 17 $mm^2$, an aluminum electrical wire having a desired electrical conductivity can be constructed without an increase in wire outer diameter.

Specifically, because the electrical conductivity of aluminum-based core wires is lower than that of copper-based core wires of the same diameter, it is difficult to construct an aluminum-based core wire assured to have electrical conductivity similar to that of a corresponding copper-based core wire when the cross-sectional area of the conductor constituted of a plurality of aluminum-based core wires is less than 2.5 $mm^2$. Conversely, when the cross-sectional area of the conductor constituted of a plurality of aluminum-based core wires is not less than 17 $mm^2$, although electrical conductivity similar to that of a corresponding copper-based electrical wire can be assured, there is a possibility that rigidity of the conductor will be high, flexibility will be lost, and the bending performance of the electrical wire will decrease.

However, by constructing a conductor with a cross-sectional area of not less than 2.5 $mm^2$ and less than 17 $mm^2$, an aluminum electrical wire having substantially the same diameter and current capacity as a copper electrical wire can be obtained and a desired bending performance can also be maintained. Specifically, because the thickness of the insulating covering that covers the conductor can be made thin within a range that can protect the conductor, it can have the same outer diameter as a copper electrical wire of similar current capacity and can also have a desired bending performance.

As a mode of the present invention, the thickness of the insulating resin covering may be not less than 10% and not greater than 20% of the conductor outer diameter.

When the thickness of the insulating resin covering is less than 10%, there is a possibility that the required performance such as insulating properties and strength of the insulating resin covering cannot be satisfied. Conversely, when the thickness of the insulating resin covering is greater than 20% of the conductor outer diameter, there is a possibility that the electrical wire outer diameter will be larger than a copper electrical wire of similar electrical conductivity. In contrast, because the thickness of the insulating resin covering is not less than 10% and not greater than 20% of the conductor outer diameter, an aluminum electrical wire having a desired electrical conductivity can be constructed without an increase in the electrical wire outer diameter.

Additionally, with a conductor constituted of a plurality of aluminum-based core wires, there is the concern that the conductor outer diameter will be larger than that of a conductor constituted of copper-based core wires having similar electrical conductivity and flexibility will decrease, but because aluminum-based core wires are constituted of aluminum-based material which is flexible, that is, has low hardness, and contains not less than 99 mass % of aluminum, the aluminum-based core wires themselves have an appropriate degree of flexibility and can form aluminum electrical wires having suitable flexibility.

Furthermore, when the aluminum electrical wire is crimp-connected at a crimping portion of a crimping terminal, it can be properly connected by crimping without the crimping portion being damaged.

Specifically, when a conductor is constructed by twisting aluminum-based core wires containing less than 99 mass % of aluminum, because the hardness of the aluminum-based core wires increases, there is a possibility of the crimping portion of the crimping terminal being damaged when the conductor constituted of the aluminum-based core wires is crimped at a predetermined crimping rate. However, by using a conductor constituted of aluminum-based core wires containing not less than 99 mass % of aluminum of low hardness, the conductor can be properly connected by crimping without the crimped crimping portion being damaged.

As a mode of the present invention, the thickness of the insulating resin covering may be not less than 7% and not greater than 14% of the electrical wire outer diameter.

According to the present invention, an aluminum electrical wire in which the lowest thickness of insulating resin covering is assured can be constructed.

Furthermore, as a mode of the present invention, the insulating resin covering may have a tensile strength at 23°

C. of not less than 14 MPa, a heat deformation rate of not greater than 25%, a cold tolerance of not higher than −15° C., and a volume resistivity at 30° C. of not less than $1\times10^{12}$ Ω·cm.

According to the present invention, an aluminum electrical wire that satisfies the required performance of an insulating resin covering can be constructed without an increase in electrical wire diameter and without the mechanical strength of the insulating resin covering decreasing.

Note that "tensile strength," "heat deformation rate," "cold tolerance," and "volume resistivity" are those defined based on Japanese Industrial Standards JIS K 6723-2006 "Plasticized polyvinyl chloride compounds." Furthermore, an error of ±0.5° C. is permitted in the standard temperature of "tensile strength" and "volume resistivity" (similarly hereinafter).

As a mode of the present invention, the cross-sectional area of the conductor may be not less than 5 $mm^2$, and the thickness of the insulating resin covering may be not greater than 15% of the conductor outer diameter.

According to the present invention, an aluminum electrical wire having electrical conductivity similar to that of an insulated electrical wire having a copper conductor, and in which a required thickness can be reliably assured even when the insulating resin covering is thin, can be constructed without an increase in electrical wire outer diameter.

Advantageous Effects of Invention

According to the present invention, an aluminum electrical wire having electrical conductivity similar to that of an insulated electrical wire having a copper conductor can be provided without an increase in wire outer diameter.

DESCRIPTION OF EMBODIMENTS

Figure 1:
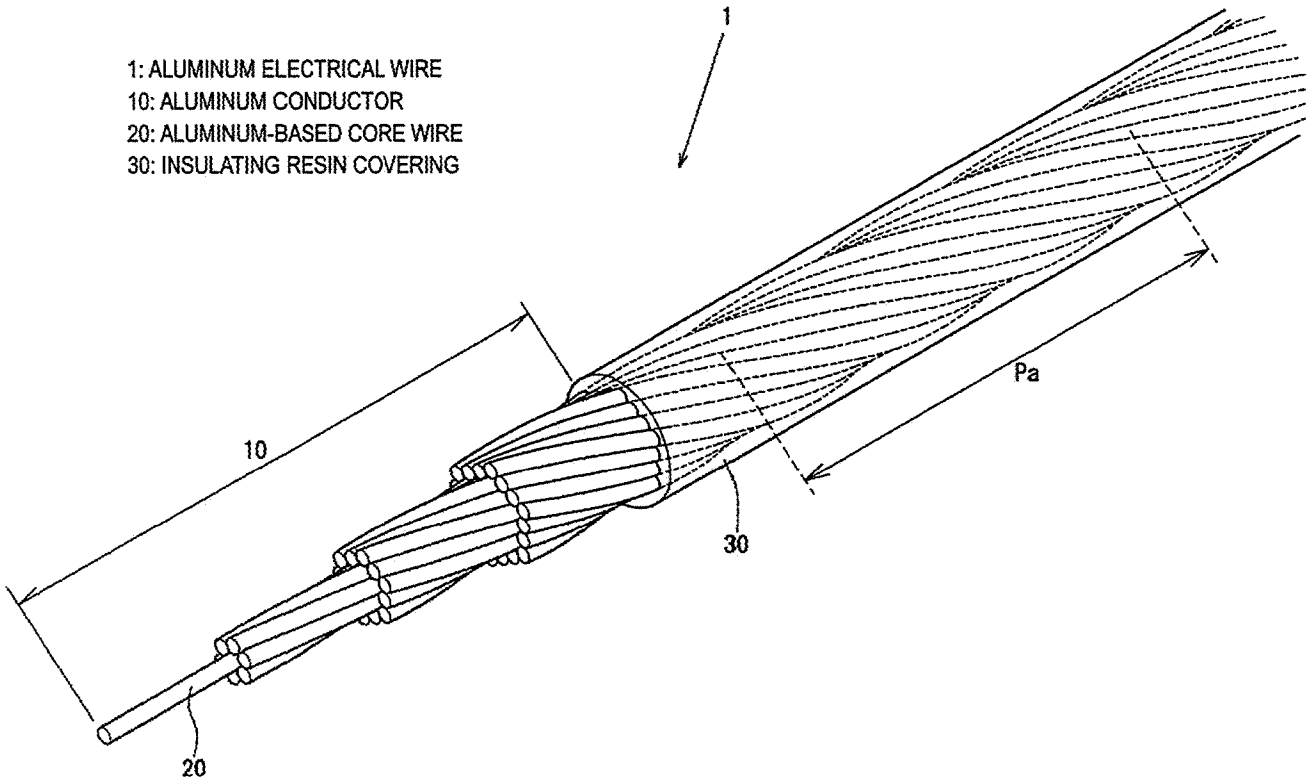
FIG. 1 is a schematic perspective view of an insulated electrical wire.
Figure 2A:
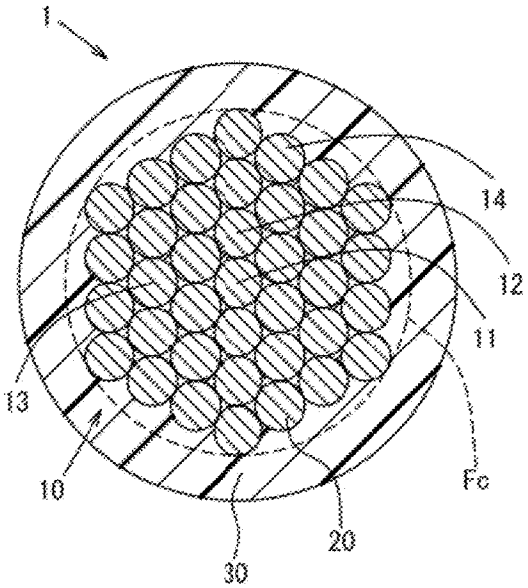
FIGS. 2A and 2B are explanatory views of an aluminum electrical wire.
Figure 2B:
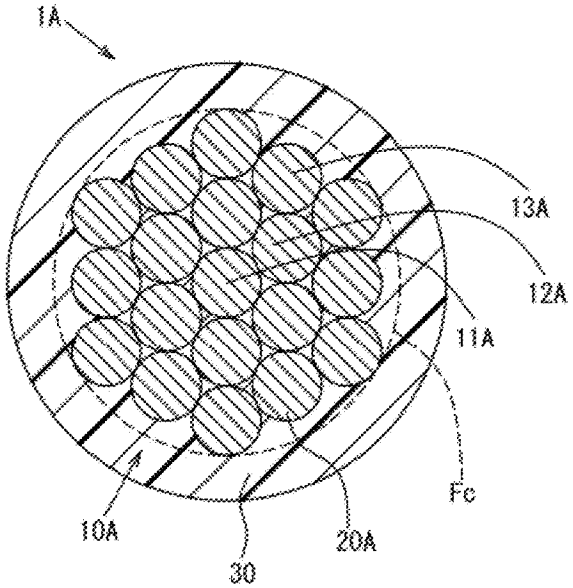

FIG. 1 illustrates a schematic perspective view of an aluminum electrical wire 1. FIGS. 2A and 2B illustrate explanatory views of aluminum electrical wire 1, 1A. More specifically, FIG. 2A illustrates a cross-sectional view of the aluminum electrical wire 1, and FIG. 2B illustrates a cross-sectional view of an aluminum electrical wire 1A. Note that in FIG. 1, the aluminum conductor 10 inside the insulating resin covering 30 is illustrated as a dotted line.

Figure 3A:
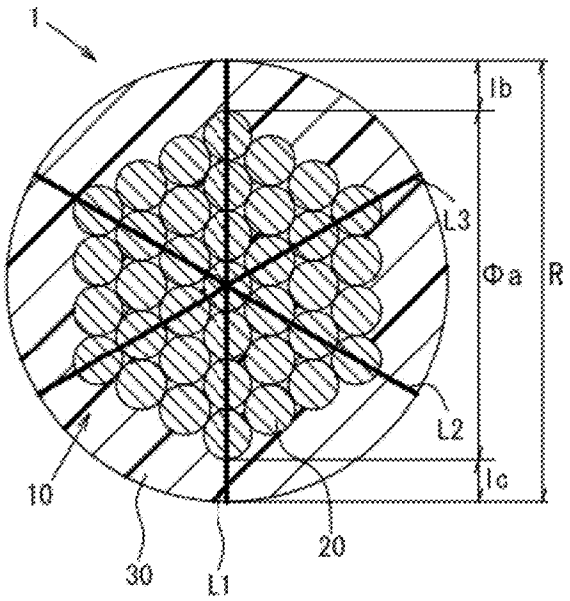
FIGS. 3A and 3B are explanatory views of an aluminum electrical wire.
Figure 3B:
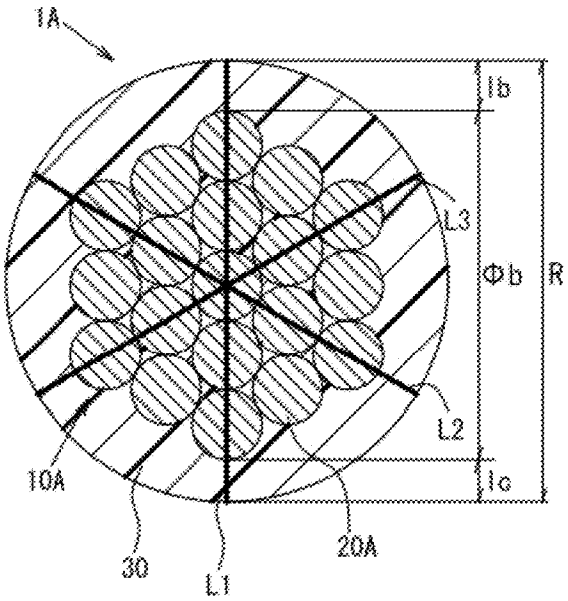

FIGS. 3A and 3B illustrate explanatory views with regard to the thickness of the insulating resin covering 30 in the aluminum electrical wire 1.

Figure 4:
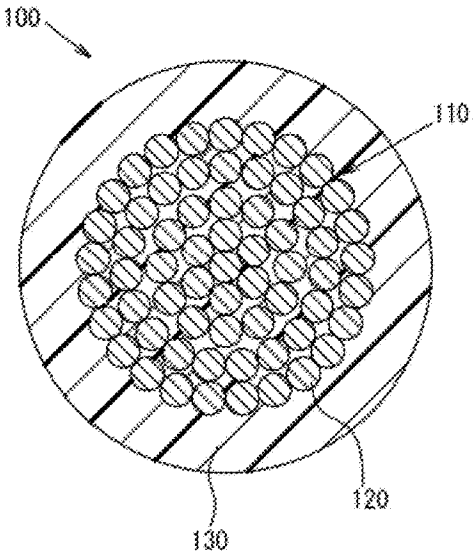
FIG. 4 is an explanatory view of a copper electrical wire.

FIG. 4 illustrates a cross-sectional view of a copper electrical wire 100.

The aluminum electrical wire 1 illustrated in FIGS. 1 and 2A is constructed by covering the aluminum conductor 10 constructed by concentrically twisting, in a non-compressed state, 37 aluminum-based core wires 20 containing not less than 99 mass % of aluminum with the insulating resin covering 30.

The aluminum electrical wire 1 having electrical conductivity similar to that of a so-called 5 sq (electrical wire having a conductor cross-sectional area of approximately 5 $mm^2$ wherein "sq" means "$mm^2$"; similarly hereinafter) copper electrical wire (see FIG. 4) is an electrical wire of a size called 8 sq. Specifically, the aluminum conductor 10 having a conductor outer diameter ϕa of 3.64 mm is constructed by concentrically twisting 37 of the aluminum-based core wires 20 having a diameter of 0.52 mm, and the aluminum conductor 10 is covered with the insulating resin covering 30 having a thickness of 0.4 mm, to construct the aluminum electrical wire 1 having a finished outer diameter of 4.4 mm.

Here, the conductor outer diameter ϕ is measured by the method described in JASO-D-618, and indicates the diameter of the circumscribed circle of a cross-sectionally regular hexagonal form formed by the aluminum conductor 10 that constitutes the aluminum electrical wire 1 (see FIGS. 3A and 3B).

Furthermore, "thickness" indicates the average value of thickness of the insulating resin covering 30 that covers the aluminum conductor 10. Specifically, it indicates the average of values obtained by multiplying the difference between the electrical wire outer diameter (finished outer diameter R) and the conductor outer diameter ϕ at a plurality of arbitrary points by ½.

As illustrated in FIGS. 3A and 3B, among the thickness portions of the insulating resin covering 30 covering the aluminum conductor 10 in the aluminum electrical wire 1, the thickness lc of the thinnest location is taken as the insulator minimum thickness. In contrast, among the portions on a straight line that connects the thickness lc at which the insulator minimum thickness was measured and the center of the aluminum conductor, the thickness of the covering on the side opposite the side exhibiting the insulator minimum thickness, that is, the thickness lb of the thick location on the above straight line, is taken as the insulator maximum thickness.

Furthermore, the ratio of the insulator minimum thickness (thickness lc) relative to the insulator maximum thickness (thickness lb) is taken as lc/lb (see FIGS. 3A and 3B), and the minimum value of data acquired at three or more locations (four locations in the example below), which are at positions selected such that they are not at an integral multiple of the twisting pitch in the length direction and such that the length between the two farthest points is longer than the twisting pitch, is taken as the thickness deviation. Note that the thickness deviation of the aluminum electrical wire 1 in the present embodiment is 78%.

Specifically, the thickness deviation is calculated as follows. Five aluminum electrical wires 1 of a predetermined length are produced, and on a cross-section relative to the length direction selected so as to satisfy the above conditions, straight lines (measurement lines L) are drawn. These lines are extensions of the lines that connect opposing vertices of the hexagonal form in which the aluminum conductor 10 is formed to the outer periphery of the aluminum electrical wire 1. The lengths of the thicknesses (thickness lb, thickness lc) of the insulating resin covering 30 between the aluminum conductor 10 and aluminum electrical wire 1 of the measurement lines L are measured, and the ratio (lc/lb) of the thickness lc relative to the thickness lb is calculated as a percentage.

Here, because the aluminum conductor 10 has a hexagonal form, three measurement lines L can be drawn, and the minimum value of the thickness deviations calculated from the three measurement lines (L1 to L3) is taken as the thickness deviation of the aluminum electrical wire 1.

Note that the thickness deviation is calculated in the same manner for the aluminum electrical wire 1A described below.

As illustrated in FIG. 3A, when the aluminum electrical wire 1 is constituted of an aluminum conductor 10 having 37 aluminum-based core wires 20, one aluminum-based core wire 20 is disposed in the center (center core wire 11), and on the periphery thereof, 6 (second layer 12), 12 (third layer 13), and 18 (fourth layer 14) aluminum-based core wires 20 are disposed in that order from the center. The aluminum conductor 10 is constructed by concentrically twisting the second layer 12, third layer 13, and fourth layer 14 at the same twisting pitch Pa.

The aluminum-based core wires 20 are constituted of so-called pure aluminum-based material (aluminum-based material of a composition corresponding to JIS H4000 1070 series), which is constituted of not less than 99.7 mass % of aluminum, and has electrical conductivity of not less than 61.2% IACS, tensile strength of from 70 to 120 MPa, and tensile elongation of not less than 16%. However, the aluminum-based core wires 20 may also be constituted of an aluminum-based material which contains not greater than 0.10 mass % of Si, from 0.2 to 0.23 mass % of Fe, from 0.16 to 0.23 mass % of Cu, not greater than 0.005 mass % of Mn, from 0.12 to 0.15 mass % of Mg, not greater than 0.05 mass % of Ti+V, and the balance not less than 99 mass % of aluminum, and has electrical conductivity of not less than 58% IACS, tensile strength of not less than 90 MPa, and tensile elongation of not less than 8%. That is, an aluminum conductor 10 having sufficient flexibility and desired electrical conductivity can be manufactured using, as the material of the aluminum-based core wires 20 of the invention of the present application, a material of which the detailed constitution is not limited provided that it is an aluminum alloy material of not less than 99% purity and having electrical conductivity on the level of 60%.

The insulating resin covering 30 is an insulating resin covering made of polyvinyl chloride ("PVC" hereinafter) having a tensile strength at 23° C. of not less than 19.6 MPa, a heat deformation rate of not greater than 25%, a cold tolerance of not higher than −20° C., and a volume resistivity at 30° C. of not less than $3\times10^{12}$ Ω·cm.

In an aluminum electrical wire 1 constructed in this manner, the total cross-sectional area of an aluminum conductor 10 having a conductor outer diameter of 3.64 mm constructed by concentrically twisting 37 aluminum-based core wires 20 having a diameter of 0.52 mm is 7.85 $mm^2$.

Furthermore, an insulating resin covering 30 of thickness 0.4 mm is constructed with a thickness of 11%, which is not less than 10% and not greater than 15%, relative to the aluminum conductor 10 having a conductor outer diameter of 3.64 mm, and is constructed with a thickness of 9%, which is not less than 7% and less than 14%, relative to the aluminum electrical wire 1 having a finished outer diameter of 4.4 mm.

In contrast, as illustrated in FIG. 2B, an aluminum electrical wire 1A having an aluminum conductor 10A constructed by concentrically twisting 19 aluminum-based core wires 20A is an electrical wire of a size called 8 sq similar to the above aluminum electrical wire 1. An aluminum conductor 10A having a conductor outer diameter ϕb of 3.65 mm is constructed by concentrically twisting 19 aluminum-based core wires 20A of diameter 0.73 mm. The aluminum conductor 10A is covered with an insulating resin covering 30 of thickness 0.4 mm, to construct an aluminum electrical wire 1A having a finished outer diameter of 4.4 mm.

Note that the thickness deviation of the aluminum electrical wire 1A is 80%.

Furthermore, when the aluminum conductor 10A is constituted of 19 aluminum-based core wires 20A, one aluminum-based core wire 20A is disposed in the center (center core wire 11A), and on the periphery thereof, 6 (second layer 12A) and 12 (third layer 13A) aluminum-based core wires 20A are disposed in that order from the center. The aluminum conductor 10A is constructed by concentrically twisting the second layer 12A and third layer 13A at the same twisting pitch Pa.

In an aluminum electrical wire 1A constructed in this manner, the total cross-sectional area of an aluminum conductor 10A having a conductor outer diameter ϕb of 3.65 mm constructed by concentrically twisting 19 aluminum-based core wires 20 having a diameter of 0.73 mm is 7.95 $mm^2$.

Furthermore, an insulating resin covering 30 of thickness 0.4 mm is constructed with a thickness of 11%, which is not less than 10% and not greater than 15%, relative to the aluminum conductor 10A having a conductor outer diameter of 3.65 mm, and is constructed with a thickness of 9%, which is not less than 7% and less than 14%, relative to the aluminum electrical wire 1A having a finished outer diameter of 4.4 mm.

A copper electrical wire 100 having electrical conductivity similar to that of the aluminum electrical wire 1, 1A having the aluminum conductor 10, 10A constituted of the aluminum-based core wires 20 is, for example, an electrical wire of a size called 5 sq as illustrated in FIG. 4. A copper conductor 110 having a conductor outer diameter of 3.0 mm is constructed by bunch-stranding 65 copper core wires 120 of diameter 0.32 mm. The copper conductor 110 is covered with an insulating resin covering 30 of thickness 0.7 mm, to construct a copper electrical wire 100 having a finished outer diameter of 4.4 mm (see Table 3).

The total cross-sectional area of the copper conductor 110 constituted of copper core wires 120, which have higher electrical conductivity than the aluminum-based core wires 20, is 5.22 $mm^2$, which is smaller than the total cross-sectional area of 7.95 $mm^2$ of the aluminum conductor 10, 10A in the above aluminum electrical wire 1, 1A, but the copper conductor 110 and the aluminum conductor 10, 10A have similar electrical conductivity.

In other words, although the aluminum conductor 10, 10A is larger in cross-sectional area than the copper conductor 110, the aluminum electrical wire 1, 1A is constructed to have electrical conductivity, that is, permitted current, similar to and substantially the same finished diameter as the copper electrical wire 100.

Furthermore, because the aluminum-based core wires 20, 20A that constitute the aluminum electrical wire 1, 1A have a much lighter specific gravity (approximately ⅓) than the copper core wires 120 that constitute the copper conductor 110, the total the mass of the aluminum electrical wire 1, 1A can be made lighter even though the cross-sectional area of the aluminum conductor 10, 10A constituted of the aluminum-based core wires 20, 20A is larger.

Additionally, in a typical insulated electrical wire, the thickness of the insulating resin covering is designed such that a predetermined insulator minimum thickness is assured. Because the aluminum electrical wire 1, 1A has a thickness deviation of not less than 70%, the difference between the insulator minimum thickness (thickness lc) and the insulator maximum thickness (thickness lb) can be small. As a result, because the thickness of the insulating resin covering at the position of insulator maximum thickness (thickness lb) can be thin, the aluminum conductor 10, 10A can be protected by the insulating resin covering 30 even in an aluminum electrical wire 1, 1A having a desired outer diameter, and the cross-sectional outer diameter of the aluminum electrical wire 1, 1A can be small.

Furthermore, the insulating resin covering 30 is an insulating resin covering made of PVC having a tensile strength at 23° C. of not less than 16.2 MPa, a heat deformation rate of not greater than 40%, a cold tolerance of not higher than −17° C., and a volume resistivity at 30° C. of not less than $1\times10^{11}$ Ω·cm.

In this way, it is possible to construct an aluminum electrical wire 1, 1A having an outer diameter similar to that of the copper electrical wire 100 by covering the aluminum conductor 10, 10A with an insulating resin covering 30 having higher-performance properties than an aluminum conductor 10, 10A having an outer diameter larger than a copper conductor 110 having a conductor outer diameter of 3.0 mm, and more specifically, by covering the aluminum conductor 10 with an insulating resin covering 30 having a thickness of 0.4 mm, which is thinner than the 0.7 mm thickness of the insulating resin covering 30.

The manufacturing apparatus and the method for manufacturing the above aluminum electrical wire 1, 1A will be described below.

First, the manufacturing apparatus and manufacturing apparatus for the above aluminum electrical wire 1, 1A will be described below based on FIGS. 5 to 9.

Figure 5:
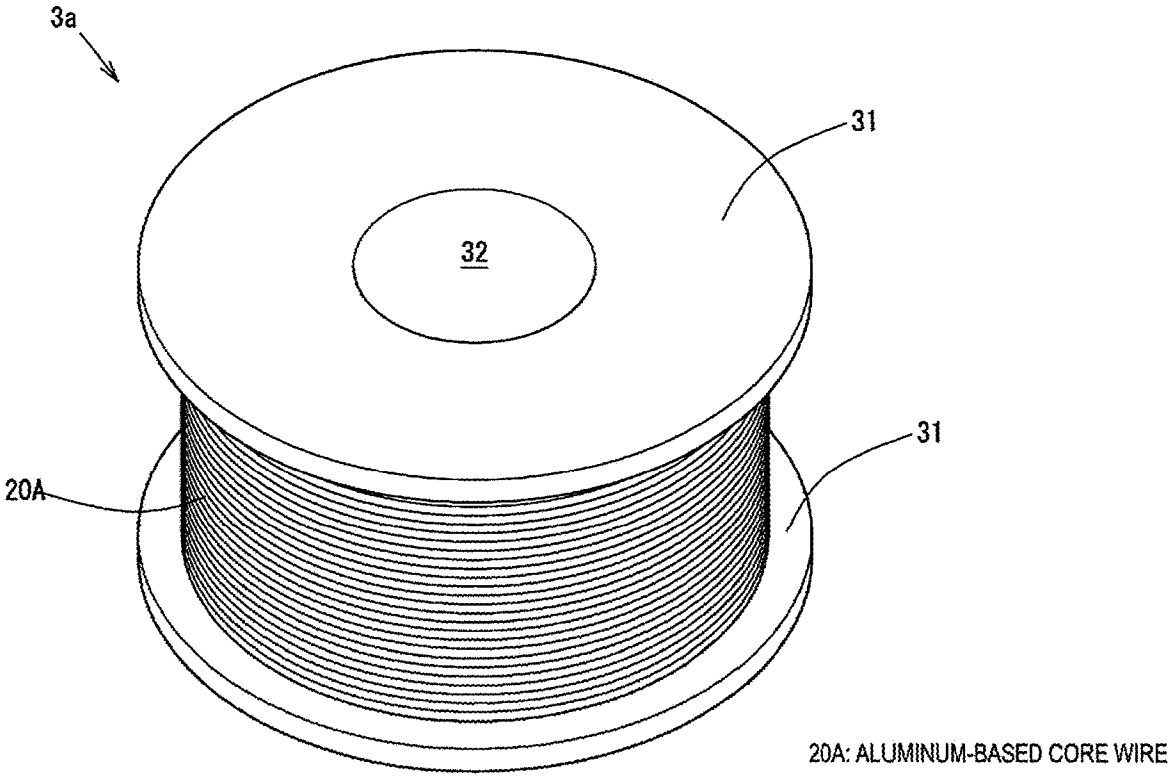
FIG. 5 is a perspective view of a bobbin.
Figure 6:
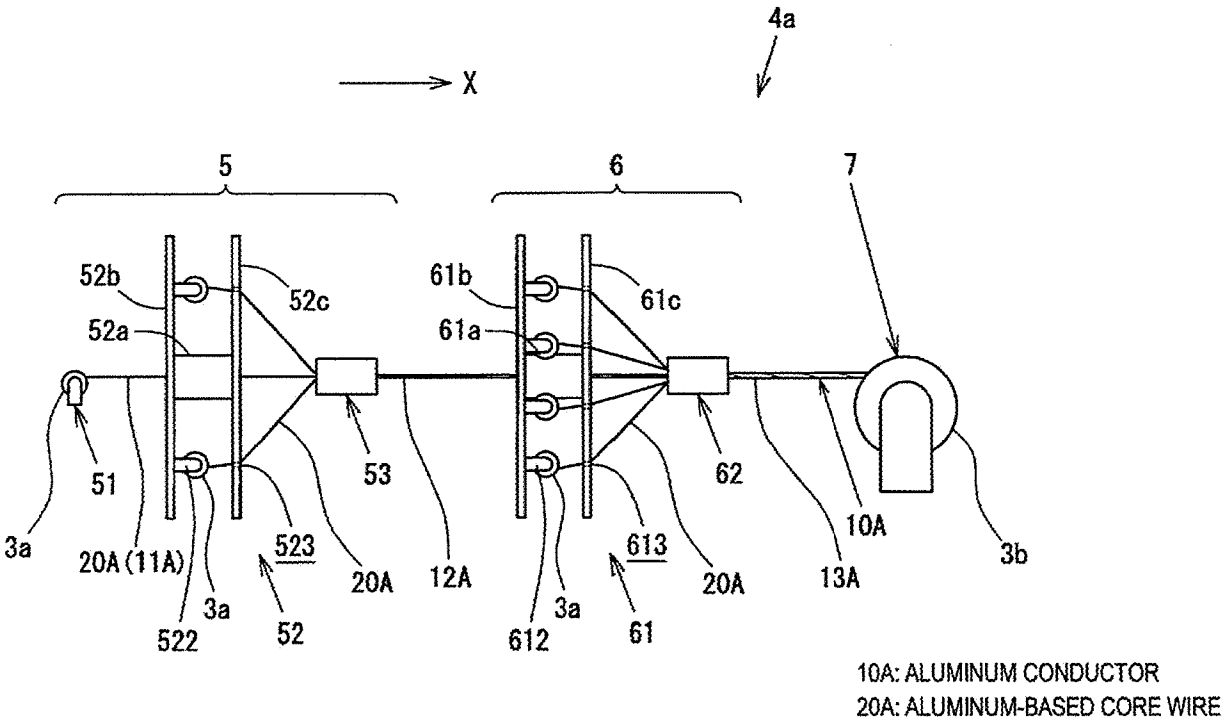
FIG. 6 is a schematic view of a twisting machine which twists a twisted wire conductor constituted of 19 soft core wires.
Figure 7:
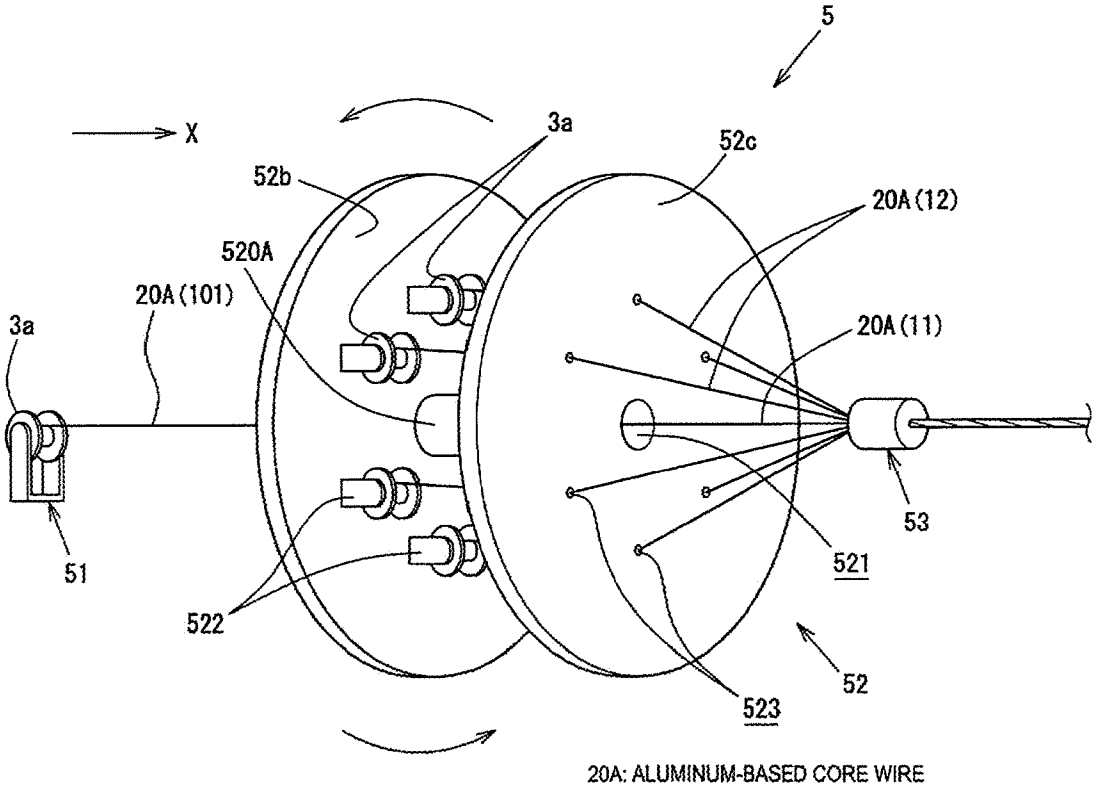
FIG. 7 is an enlarged perspective view of a second-layer twisting unit.

FIG. 5 illustrates a perspective view of a bobbin 3*a* in a state where aluminum-based core wire 20A has been wound around it. FIG. 6 illustrates a schematic view of a twisting machine 4*a*. FIG. 7 illustrates an enlarged perspective view of a second-layer twisting unit 5. FIGS. 8A to 8D are explanatory views of an insulating resin covering machine 300 which covers an aluminum conductor 10A with an insulating resin covering 30. FIG. 9 is a flowchart for describing a method for manufacturing the aluminum conductor 10A in a first embodiment.

FIG. 6 is a schematic view of a twisting machine 4*a*, simplified so that differences in the number of second bobbin attachment portions 522 and third bobbin attachment portions 612 which attach the bobbins 3*a* can be easily understood.

Figures 8A, 8B, 8C, 8D:
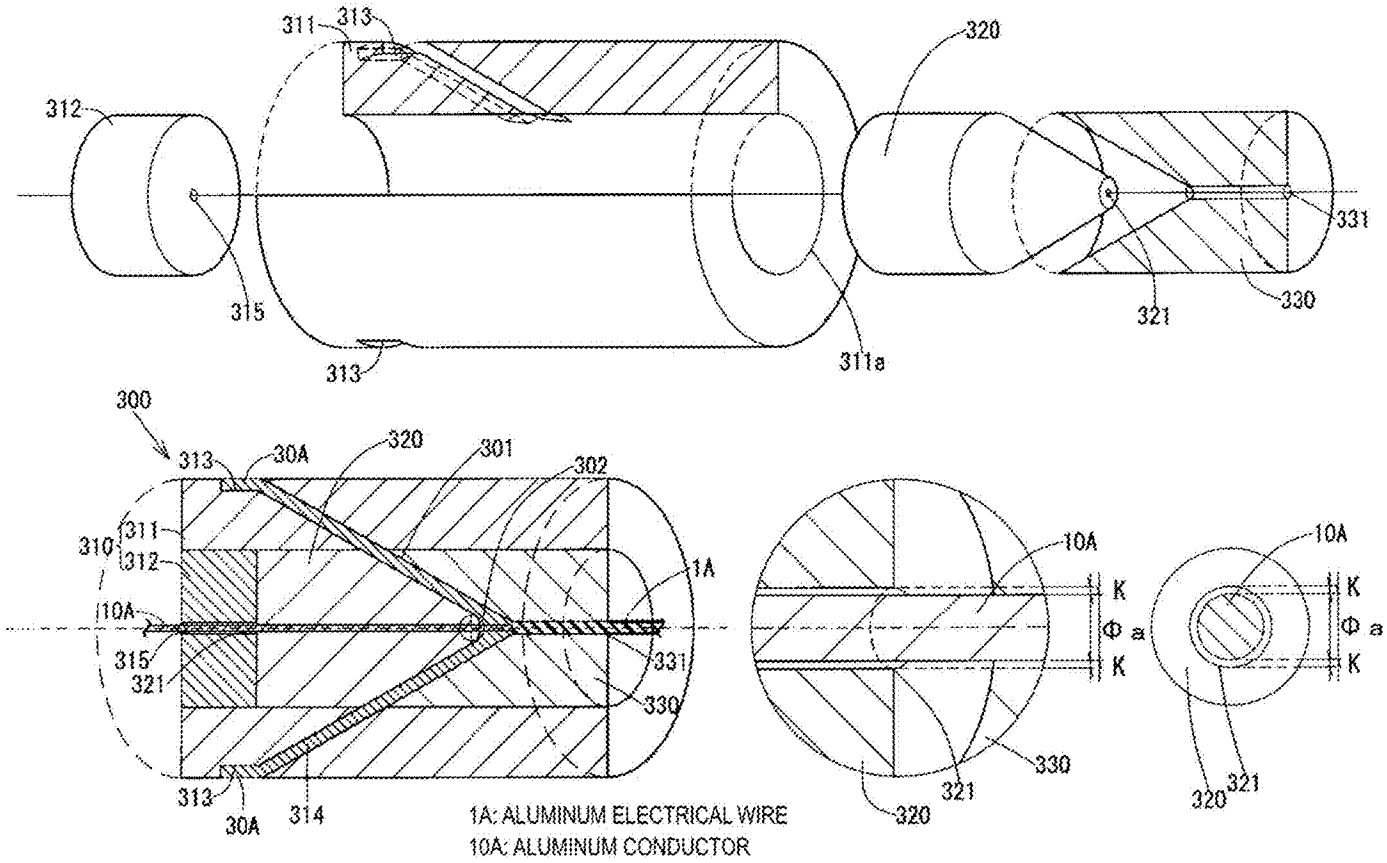
FIGS. 8A to 8D are explanatory views of an insulating resin covering machine which covers a twisted wire conductor with an insulating resin covering.
Figure 9:
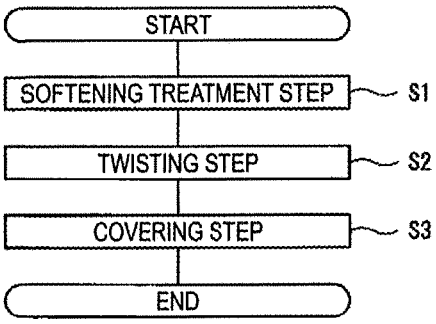
FIG. 9 is a flowchart for describing a method for manufacturing a twisted wire conductor in which soft core wires are twisted.

To describe FIGS. 8A to 8D in detail, FIG. 8A illustrates a schematic exploded perspective view of an insulating resin covering machine 300, and FIG. 8B illustrates a schematic perspective view showing a perpendicular cross-section along the advancement direction X so as to pass through the center of the insulating resin covering machine 300. FIG. 8C illustrates an enlarged view of the a portion of FIG. 8B, and FIG. 8D illustrates a front cross-sectional view looking at a tip portion of a nipple 320 from the advancement direction X.

Note that FIGS. 8A and 8B are partially depicted as dotted lines so that the inner structure is easy to understand. They illustrate a partial cross-sectional view.

The aluminum conductor 10A constructed as described above is manufactured using: bobbin 3*a* around which the aluminum-based core wires 2A are wound, wherein the aluminum-based core wires 2A are soft core wires obtained by performing a softening treatment on hard core wire beforehand; a twisting machine 4*a*, which twists the aluminum-based core wires 20A; and a bobbin 3*b*, which reels in the aluminum conductor 10A. The construction of the bobbins 3*a* and 3*b* and the twisting machine 4*a* will be described below.

First, as illustrated in FIG. 5, each bobbin 3*a* is constructed by integrating an axial core (not illustrated) around which the aluminum-based core wire 20A is wound, and annular flanges 31 and 31 provided at both ends of the axial core.

The axial core is formed in a round cylindrical form having a through-hole 32 penetrating in the axial direction.

The inner periphery of the flanges 31 and 31 is fixed to the outer periphery at the end portions of the axial core.

The bobbin 3*b* has the same construction as the bobbin 3*a*, and a description thereof is therefore omitted.

Next, as illustrated in FIG. 6, the twisting machine 4*a* is constructed by disposing a second-layer twisting unit 5 which twists the second layer 12, a third-layer twisting unit 6 which twists the third layer 13, and a conductor reeling part 7 which reels in the aluminum conductor 10A, in that order.

Note that the direction in which the second-layer twisting unit 5, third-layer twisting unit 6, and conductor reeling part 7 are disposed, that is, the direction from the left side to the right side in FIGS. 6 and 7, is the advancement direction X in which the aluminum-based core wires 20A advance.

As illustrated in FIG. 7, the second-layer twisting unit 5 is constructed by disposing a first bobbin attachment portion 51 which attaches the bobbin 3*a* around which the aluminum-based core wire 20A constituting the center core wire 11 has been wound, a second-layer twisting member 52 which attaches the bobbin 3*a* around which the aluminum-based core wires 20A constituting the second layer 12 have been wound, and a second-layer bunching chuck 53 which bunches the second layer 12 on the center core wire 11, in that order toward the advancement direction X.

The first bobbin attachment portion 51 includes a rotor shaft which passes through the through-hole 32 of the bobbin 3*a* and attaches the bobbin 3*a* such that it can turn, and a rotation control unit which controls the rotation speed of the rotor shaft.

The rotation control unit of the first bobbin attachment portion 51, via the rotation control unit of the conductor reeling part 7 to be described later, can control the rotation speed of the rotor shaft to which the bobbin 3*a* is attached in accordance with the rotation speed of the rotating bobbin 3*b* and can exert a desired tensile force on the aluminum-based core wires 20A being unwound.

The second-layer twisting member 52 is constructed by integrating a round cylindrical axial core 52*a* extending in the advancement direction X, a disc-shaped first flange 52*b* provided on the side of the axial core 52*a* nearest the first bobbin attachment portion 51, and a disc-shaped second flange 52*c* provided on the side opposite the first bobbin attachment portion 51. It also includes a rotation mechanism not illustrated in the drawings.

The axial core 52*a* has a through-hole 521 which penetrates to the inner part along the advancement direction X. The axial core 52*a* supports the first flange 52*b* and the second flange 52*c* in a state separated at a predetermined spacing.

The first flange 52*b* is formed in a disc shape having in the center a hole of the same diameter as the outer diameter of the axial core 52*a*. The inner periphery of the first flange 52*b* is fixed to the outer periphery on the end portions of the axial core 52*a*, and the first flange 52*b* has six second bobbin attachment portions 522 having the same construction as the first bobbin attachment portion 51.

The six second bobbin attachment portions 522 are disposed separated at equal spacing on concentric circles, and are disposed on the face of the first flange 52*b* on the side nearest the second flange 52*c* so as to form a substantially regular hexagonal form as seen from the advancement direction X.

The second flange 52*c*, similar to the first flange 52*b*, is formed in a disc shape having in the center a hole of the same diameter as the outer diameter of the axial core 52*a*. The inner periphery of the second flange 52*c* is fixed to the outer periphery at the end portions of the axial core 52*a*, and the second flange 52*c* has six insertion holes 523 through which the unwound aluminum-based core wires 20A pass from the bobbins 3*a* attached to the second bobbin attachment portions 522.

The six insertion holes 523 are formed in circular forms larger in diameter than the aluminum-based core wires 20A, and are disposed at positions opposing the second bobbin attachment portions 522 and separated at equal spacing on concentric circles, that is, so as to form a substantially regular hexagonal form as seen from the advancement direction X.

Note that, as described above, the number of second bobbin attachment portions 522 is equal to the number of bobbins 3*a* attached to the second-layer twisting member 52, and the number of insertion holes 523 is equal to the number of aluminum-based core wires 20A constituting the second layer 12. That is, the number of second bobbin attachment portions 522, the number of insertion holes 523, the number of aluminum-based core wires 20A constituting the second layer, and the number of bobbins 3*a* around which the aluminum-based core wires 20A are wound are equal.

The rotation mechanism provided on the second-layer twisting member 52 is provided on the axial core 52*a* and is a mechanism that turns the second-layer twisting member 52 around the center axis (for example, in the direction of the arrows in FIG. 7) of the round cylindrical axial core 52*a* which extends in the advancement direction X.

Note that the rotation mechanism is not limited to be provided on the axial core 52*a* and may be provided on the first flange 52*b* or second flange 52*c*, as long as it can turn the second-layer twisting member 52.

The second-layer bunching chuck 53 is formed in a round cylindrical form having an inner diameter equal to the diameter of the center core wire 11 and second layer 12, that is, the outer diameter of the second layer 12. It bunches the six aluminum-based core wires 20A that passed through the insertion holes 523 around the center core wire 11 that passed through the through-hole 521.

The third-layer twisting unit 6 is constituted of a third-layer twisting member 61 and a third-layer bunching chuck 62. Note that the third-layer twisting member 61 and the third-layer bunching chuck 62 have the same constructions as the second-layer twisting member 52 and the second-layer bunching chuck 53 of the second-layer twisting unit 5, and thus they are not illustrated in the drawings and are described in simple terms below.

The third-layer twisting member 61 is constructed by integrating an axial core 61*a*, a first flange 61*b*, and a second flange 61*c*. It has a rotation mechanism which is not illustrated in the drawings.

The axial core 61*a* is formed in a round cylindrical form having a through-hole which penetrates to the inner part along the advancement direction X (not illustrated).

The first flange 61*b* has 12 third bobbin attachment portions 612, and the second flange 61*c* forms 12 insertion holes 613.

These third bobbin attachment portions 612 and insertion holes 613 are disposed at mutually opposing positions so as to form a substantially regular hexagonal form as seen from the advancement direction X. The third bobbin attachment portions 612 and insertion holes 613 are provided one by one at equal spacing between the third bobbin attachment portions 612 and insertion holes 613 provided at the vertices.

The rotation mechanism provided on the third-layer twisting member 61 is provided on the axial core 61*a* and has the same construction as the rotation mechanism provided on the above second-layer twisting member 52.

Note that the rotation mechanism is not limited to being provided on the axial core 61*a*, similar to the rotation mechanism provided on the second-layer twisting member 52.

The third-layer bunching chuck 62 is formed in a round cylindrical form having an inner diameter equal to the conductor outer diameter ϕb, that is, the outer diameter of the third layer 13, and bunches the 12 aluminum-based core wires 20A that passed through the insertion holes 613 around the second layer 12 that passed through the through-hole.

The conductor reeling part 7, similar to the first bobbin attachment portion 51, includes a rotor shaft which passes through the through-hole 32 of the bobbin 3*b* and attaches the bobbin 3*b* such that it can turn, and a rotation control unit which controls the rotation speed of the rotor shaft (not illustrated). That is, the conductor reeling part 7 can reel in the aluminum conductor 10A on the bobbin 3*b* attached to the rotor shaft by means of the rotation mechanism turning the rotor shaft.

Note that in the description below, turning of the first bobbin attachment portion 51, the second bobbin attachment portion 52, the third bobbin attachment portion 612, and the conductor reeling part 7 is called "rotation" for convenience, and turning of the second-layer twisting member 52 and third-layer twisting member 61 is called "revolution."

The twisting machine 4*a* twists the second layer 12 on the outer side of the center core wire 11 via the second-layer twisting member 52 and the second-layer bunching chuck 53 to construct the second layer 12, and also twists the third layer 13 on the outer side of the second layer 12 via the third-layer twisting member 61 and the third-layer bunching chuck 62, to construct the aluminum conductor 10A.

Note that by controlling the rotation speed and the rotation start timing of the second-layer twisting unit 5, the third-layer twisting unit 6, and the conductor reeling part 7, the aluminum-based core wires 20A can be twisted at a predetermined twisting pitch Pa and a predetermined tensile force can be exerted on the aluminum-based core wires 20A.

The aluminum electrical wire 1A can be manufactured by covering the aluminum conductor 10A constructed in this manner with an insulating resin (PVC) serving as the insulating resin covering 30.

An insulating resin covering machine 300 which covers the aluminum conductor 10A with the insulating resin covering 30 will be described below based on FIGS. 8A to 8D. Note that FIGS. 8A to 8D illustrate cross-sectional views along the advancement direction X at the center location of the insulating resin covering machine 300.

As illustrated in FIGS. 8A to 8D, the insulating resin covering machine 300 is constituted of a closed-bottom round cylindrical main body 310 which is the main portion of the insulating resin covering machine 300 and is disposed along the advancement direction X, a nipple 320 mounted on the center portion proximal end side of the main body 310, and a die 330 attached to the end portion on the advancement direction side of the main body 310.

The main body 310 is constituted of a cylindrical casing 311 which forms the outer side of the insulating resin covering machine 300, and a crosshead 312 mounted on a through-hole 311*a* provided in the center portion of the casing 311. In the casing 311 are formed a resin reservoir 313 which holds liquid PVC resin 30A which is the material of the insulating resin covering 30, and an insertion passage 314 which penetrates the resin reservoir 313 and feeds the liquid PVC resin 30A to the inner part.

The crosshead 312 is a round cylindrical body that fits onto the proximal end side in the advancement direction X of the through-hole 311*a* formed in the center portion of the casing 311. In the center portion of the bottom face, a conductor through-hole 315 which is larger than the aluminum conductor 10A is formed.

The nipple 320 is a round rod formed along the advancement direction X. The tip portion thereof is constructed in a round truncated cone shape which narrows in the advancement direction X. Note that the center portion of the nipple 320 has a slightly smaller diameter than the conductor through-hole 315, and a nipple-side through-hole 321 which is larger than the outer diameter of the aluminum conductor 10A is formed along the advancement direction X.

The die 330 is a round cylindrical body which has a round bottom face having a diameter larger than the diameter of the round rod portion of the nipple 320. A round cone-shaped concave portion is formed on the proximal end side of the advancement direction X, and in the center portion of the die 330 is formed a through-hole (resin molding hole 331) constructed with a cross-sectional area much larger than the outer diameter of the aluminum conductor 10A.

As illustrated in FIGS. 8A to 8D, in the insulating resin covering machine 300 having such a construction, the crosshead 312, the nipple 320, and the die 330 are disposed in a line along the advancement direction X. Between the nipple 320 and the die 330, a passage 301 through which the liquid PVC resin 30A passes is formed, and an insulating resin reservoir 302 which can hold the liquid PVC resin 30A is formed on the tip portion of the nipple 320.

The aluminum conductor 10A is manufactured using the bobbins 3*a* and 3*b* and the twisting machine 4*a* constructed as described above. The method for subsequently manufacturing the aluminum electrical wire 1A by coating the aluminum conductor 10A with the insulating resin covering 30 using the insulating resin covering machine 300 will be described below. In the example below, an aluminum electrical wire 1A of size 8 sq is manufactured using the aluminum conductor 10A.

As illustrated in FIG. 9, the aluminum conductor 10A is manufactured by performing a softening treatment step (step S1) of constructing aluminum-based core wires 20A which have undergone softening treatment, and then performing a twisting step (step S2) of twisting 19 aluminum-based core wires 20A. The aluminum electrical wire 1A is manufactured via a coating step (step S3) of coating the aluminum conductor 10A with the insulating resin covering 30.

In the softening treatment step (step S1), unsoftened core wire that has not undergone softening treatment is softened by being left to stand for approximately 5 hours at a temperature of approximately 350 degrees in the state where it has been wound around a bobbin 3*a*, and a softened aluminum-based core wire 20A is produced.

Note that the temperature and duration in the softening treatment step are not limited to the above settings, and may be set as appropriate provided that an aluminum-based core wire 20A of desired softness can be produced. Additionally, the softening treatment step may be omitted when aluminum-based core wire of the desired softness or pre-softened aluminum-based core wire is used.

In the twisting step (step S2), six of the aluminum-based core wires 20A constituting the second layer 12 and 12 aluminum-based core wires 20A constituting the third layer 13 are disposed on the outer side of the center core wire 11, and the aluminum-based core wires 20A are sequentially twisted to manufacture the aluminum conductor 10A.

Specifically, in the twisting step (step S2), first, each of the bobbins 3*a* around which aluminum-based core wire 20A that has undergone softening treatment has been wound is attached to the first bobbin attachment portion 51, the second bobbin attachment portion 522, and the third bobbin attachment portion 612.

The tips of each of the aluminum-based core wires 20A unwound from the bobbins 3*a* attached to the bobbin attachment portions are fixed to a bobbin 3*b* attached to the conductor reeling part 7 in a state where they have been bundled by passing through a predetermined location.

When fixing of the aluminum-based core wires 20A to the bobbin 3*b* is complete, the first bobbin attachment portion 51, second bobbin attachment portion 522, third bobbin attachment portion 612, and conductor reeling part 7 are made to rotate while the second-layer twisting member 52 and third-layer twisting member 61 are made to revolve in the same direction.

Here, the rotation speeds of the first bobbin attachment portion 51, second bobbin attachment portion 522, and third bobbin attachment portion 612 are controlled in accordance with the rotation speed of the conductor reeling part 7 to exert a tensile force of 10.6 N on each of the aluminum-based core wires 20A being twisted.

Note that the tensile force exerted on the aluminum-based core wires 20A is not limited to 10.6 N, and may be set as appropriate within a range from not less than 5.3 N and not greater than 23.85 N (tensile force per unit cross-sectional area of not less than 12.5 $N/mm^2$ and not greater than 56.3 $N/mm^2$).

Additionally, the revolution speeds of the second-layer twisting member 52 and third-layer twisting member 61 are controlled in accordance with the rotation speed of the conductor reeling part 7 to twist the aluminum-based core wires 20A at a twisting pitch Pa of 44.2 mm, which is approximately 12.1 times the conductor outer diameter ϕb. Note that in the present embodiment, due to the revolution speeds of the second-layer twisting member 52 and the third-layer twisting member 61 being the same speed, the twisting pitch of the second layer 12 and the third layer 13 is 44.2 mm.

The twisting step (step S2) described above is performed until the aluminum conductor 10A reaches the desired length.

Next, the aluminum conductor 10A manufactured in the twisting step (step S2) is passed through the conductor through-hole 315 provided in the center portion of the insulating resin covering machine 300 described above, and the aluminum conductor 10A is extruded along the advancement direction X from the proximal end side of the advancement direction X. As a result, the aluminum conductor 10A passes through the insulating resin reservoir 302 which holds the liquid PVC 30A, and the outer peripheral surface of the aluminum conductor 10A is covered with the insulating resin covering 30. Finally, by passing the aluminum conductor 10A coated with the insulating resin covering 30 through the resin molding hole 331, the insulating resin covering is molded to result in a desired thickness, and the aluminum electrical wire 1A is thereby manufactured (step S3).

Here, the inner diameter of the nipple-side through-hole 321 is slightly larger than the conductor outer diameter ϕa of the aluminum conductor 10A manufactured by twisting the aluminum-based core wires 20A, but may be varied as appropriate according to the intended size of the aluminum electrical wire 1A.

For example, in the example described above, that is, in the case where the size of the aluminum electrical wire 1A is 8 sq, the clearance K of the conductor outer diameter ϕb of the aluminum conductor 10A and the nipple-side through-hole 321 is set to 0.35 mm (see FIGS. 8B, 8C, and 8D). Specifically, it is set such that the ratio of the clearance K relative to the conductor outer diameter ϕb of the aluminum conductor 10A is 9.6%. In this way, due to the clearance K being small, the aluminum conductor 10A can be disposed near the center of the aluminum electrical wire 1A when the aluminum conductor 10A is passed through the insulating resin covering machine 300.

Note that when the size of the aluminum electrical wire 1A is 5 sq, the clearance K provided between the nipple-side through-hole 321 and the aluminum conductor 10A is 0.4 mm and the ratio of the clearance K relative to the conductor outer diameter ϕb of the aluminum conductor 10A is set to 4.3%. When the size of the aluminum electrical wire 1A is 2.5 sq, the ratio of the clearance K relative to the conductor outer diameter ϕb of the aluminum conductor 10A is set to 14.3%.

In this way, the aluminum electrical wire 1, 1A can be manufactured such that the aluminum conductor 10, 10A is disposed at the center portion of the aluminum electrical wire 1, 1A because the clearance K of the aluminum conductor 10, 10A and the nipple-side through-hole 321 is not less than 5% and not greater than 15% of the conductor outer diameter ϕa, ϕb of the aluminum conductor 10, 10A.

Specifically, when the clearance K is less than 5% of the conductor outer diameter ϕa, ϕb, there is a possibility that the aluminum conductor 10, 10A will interfere with the nipple-side through-hole 321 and the aluminum conductor 10, 10A will be damaged or will be only partially covered with the insulating resin covering 30. Conversely, when the clearance K is greater than 15% of the conductor outer diameter ϕa, ϕb, when the aluminum conductor 10, 10A is passed through the conductor through-hole 315 provided in the center portion of the insulating resin covering machine 300, it is difficult to dispose the aluminum conductor 10, 10A at the center, and thus there is a possibility that the aluminum conductor 10, 10A will be disposed off center.

In contrast, when the clearance K is not less than 5% and not greater than 15% of the conductor outer diameter ϕa, ϕb, the aluminum conductor 10, 10A can be disposed in the center portion of the aluminum electrical wire 1, 1A without interfering with the nipple-side through-hole 321.

Similarly, the inner diameter of the resin molding hole 331 may be varied as appropriate in accordance with the thickness of the insulating resin covering 30, and the thickness of the insulating resin covering 30 may be varied so as to result in the appropriate desired thickness. As a result, an aluminum electrical wire 1A having an insulating resin covering 30 of a desired thickness can be manufactured. Note that the thickness of the insulating resin covering 30 is preferably not less than 10% and not greater than 20% of the conductor outer diameter ϕb.

Furthermore, in the manufacture of an 8 sq aluminum electrical wire 1A, by exerting a tensile force of 10.6 N, which is not less than 5.3 N and not greater than 23.85 N (tensile force per unit cross-sectional area of not less than 12.5 $N/mm^2$ and not greater than 56.3 $N/mm^2$), on the aluminum-based core wires 20A in the twisting step (step S2), an aluminum conductor 10A twisted at a predetermined twisting pitch Pa can be manufactured without slack.

Specifically, when twisting while exerting a tensile force of less than 5.3 N or without exerting tensile force on the aluminum-based core wires 20A, there is a possibility that slack will occur in the aluminum-based core wires 20A being twisted and slack will occur in the aluminum conductor 10A constructed by twisting.

On the other hand, when twisting while exerting a tensile force of greater than 23.85 N on the aluminum-based core wires 20A, there is a possibility that the aluminum-based core wires 20A being twisted will elongate and break.

In contrast, by exerting on the aluminum-based core wires 20A a tensile force of 10.6 N, which is not less than 5.3 N and not greater than 23.85 N, preferably not less than 7.95 and not greater than 13.25 N (tensile force per unit cross-sectional area of not less than 12.5 $N/mm^2$ and not greater than 56.3 $N/mm^2$, preferably not less than 18.8 $N/mm^2$ and not greater than 31.3 $N/mm^2$), slack can be prevented from occurring in the aluminum-based core wires 20A being twisted and in the twisted aluminum conductor 10A, and elongation and breakage of the aluminum-based core wires 20A can be prevented.

Note that the load incurred due to the tensile force exerted on the aluminum-based core wires 20 such as the aluminum-based core wires 20A is proportional to the cross-sectional area of the aluminum-based core wire. Specifically, it is preferable to exert tensile force on the aluminum-based core wires such that the tensile force per unit cross-sectional area is not less than 12.5 $N/mm^2$ and not greater than 56.3 $N/mm^2$.

As a result, aluminum-based core wires 20A can be twisted without slack at a twisting pitch of approximately 12.1 times, which is not less than 8.6 times and not greater than 22.0 times the conductor outer diameter ϕb. This makes it possible to manufacture a desired aluminum conductor 10A that prevents problems such as the aluminum-based core wires 20A being twisted in a disorderly manner and the aluminum-based core wires 20A jutting out to the exterior.

Specifically, when the twisting pitch Pa is less than 8.6 times the conductor outer diameter ϕa, the angle of the aluminum-based core wires 20A being twisted relative to the center axis of the aluminum conductor 10A is large, and there is a possibility of the aluminum-based core wires 20A being twisted in a disorderly manner.

On the other hand, when the twisting pitch Pa is greater than 22.0 times the conductor outer diameter ϕa, the twist length per pitch of the aluminum conductor 10A is long and the twisting load of the aluminum conductor 10A is dispersed, and due to the center axes of the aluminum-based core wires 20A and the aluminum conductor 10A being nearly parallel, there is a possibility of the aluminum-based core wires 20A that constitute the aluminum conductor 10A jutting out from the aluminum conductor 10A to the exterior.

In contrast, by setting the twisting pitch Pa to approximately 12.1 times, which is not less than 8.6 times and not greater than 22.0 times the conductor outer diameter ϕa, the aluminum-based core wires 20A can be twisted at a desired angle relative to the center axis of the aluminum conductor 10A, and the twisting load of the aluminum-based core wires 20A exerted on the aluminum conductor 10A can be a desired twisting load. This makes it possible to suppress problems such as the aluminum-based core wires 20A being twisted in a disorderly manner and the aluminum-based core wires 20A that constitute the aluminum conductor 10A jutting out from the aluminum conductor 10A to the exterior.

A desired aluminum conductor 10A can be thereby constructed. Thus, for example, when the outer periphery of the aluminum conductor 10A is covered with an insulating covering, it is possible to prevent the insulating covering from becoming thinner is some parts due to the aluminum-based core wires 20A jutting out to the exterior, and it is possible to obtain desired insulation performance.

Note that because the twisting pitch Pa is not less than 12.1 times and not greater than 20.7 times the conductor outer diameter ϕa, it is possible to manufacture a desired aluminum conductor 10A that reliably prevents problems such as the aluminum-based core wires 20A being twisted in a disorderly manner and the aluminum-based core wires 20A jutting out to the exterior.

Figure 10:
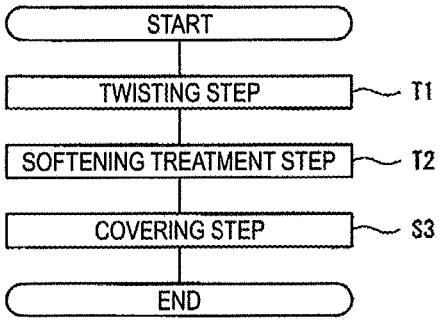
FIG. 10 is a flowchart for describing a method for manufacturing a twisted wire conductor in which hard core wires are twisted.

Furthermore, in the above example, a softening treatment was performed on the aluminum-based core wires 20A beforehand, but the softening treatment does not necessarily have to be performed beforehand, and aluminum-based core wires that have not undergone softening treatment may be used (see FIG. 10).

As illustrated in FIG. 10, in the method for manufacturing an aluminum electrical wire when aluminum-based core wires that have not undergone softening treatment are used, a twisting step (step T1), which corresponds to step S2 with aluminum-based core wires 20A that have undergone softening treatment beforehand, is performed, and then a softening treatment step (step T2), which corresponds to step S1 with aluminum-based core wires 20A that have undergone softening treatment beforehand, is performed, and then the covering step (step S3) of covering the aluminum conductor that underwent softening treatment (step T2) with an insulating resin covering 30 is performed.

In this case, a tensile force from 26.5 N to 37.1 N (tensile force per unit cross-sectional area of not less than 62.5 $N/mm^2$ and not greater than 87.5 $N/mm^2$) needs to be exerted on the aluminum-based core wires.

Furthermore, in this case, the aluminum-based core wires are not limited to a construction in which the twisting pitch is approximately 12.1 times the conductor outer diameter. The twisting pitch may be not less than 6.4 times and not greater than 16.9 times, and more preferably not less than 9.6 times and not greater than 15.4 times the conductor outer diameter ϕb.

In this way, it is possible to construct a desired aluminum conductor that suppresses problems such as the aluminum-based core wires being twisted in a disorderly manner and the aluminum-based core wires jutting out to the exterior, by constructing it of aluminum-based core wires that have not undergone softening treatment and by setting the twisting pitch to approximately 12.1 times, which is not less than 6.4 times and not greater than 16.9 times the conductor outer diameter ϕb.

Furthermore, prior to covering the aluminum conductor formed by aluminum-based core wires that have not undergone softening treatment with the insulating resin covering 30, it is necessary to perform the softening treatment step (step T2) of softening the bobbin around which the aluminum conductor has been wound by leaving it to stand for 5 hours at a temperature of 350 degrees. Note that the softening treatment step is not limited to being performed after twisting aluminum-based core wires that have not undergone softening treatment as in the present example. It can also be performed after twisting aluminum-based core wires that have undergone softening treatment.

In the above example, the manufacture of an aluminum electrical wire 1A of size 8 sq was described, but an aluminum electrical wire 1A of a size not less than 2.5 sq and not greater than 16 sq, for example, may be manufactured by appropriately adjusting the tensile force exerted on the aluminum-based core wires during manufacture such that the tensile force per unit cross-sectional area is not less than 12.5 $N/mm^2$ and not greater than 87.5 $N/mm^2$.

Next, the manufacturing apparatus and manufacturing apparatus for an aluminum electrical wire 1 composed of four layers will be described below based on FIGS. 11 and 12.

As described above, the aluminum conductor 10 is constituted of a four-layer structure in which a center core wire 11 is the first layer and 37 aluminum-based core wires 20, made from a pure aluminum-based material of a composition corresponding to JIS H 4000 1070 series which has undergone softening treatment, are concentrically disposed as illustrated in FIGS. 1 and 2A, and tt is constituted of an inner layer part 111, which is constituted of a center core wire 11, a second layer 12, and a third layer 13; and a fourth layer 14, which serves as an outermost layer on the outer side of the inner layer part 111.

As a result, the conductor outer diameter ϕa is 3.64 mm, and the total cross-sectional area of the twisted aluminum-based core wires 20 is approximately 8.0 $mm^2$ (8 sq).

Furthermore, the aluminum conductor 10 is constituted of a center core wire 11 (corresponding to the first layer); a second layer 12; a third layer 13; and a fourth layer 14 constituted of 18 aluminum-based core wires 20 disposed on the outer side of the third layer 13. The inner layer part 111 is constituted of the center core wire 11 through the third layer 13, and the outermost layer is constituted of the fourth layer 14.

Additionally, this aluminum conductor 10 is constructed such that the twisting pitch is 31.7 mm, which is approximately 8.7 times the conductor outer diameter ϕa.

Note that the aluminum conductor 10 is not limited to a construction in which the twisting pitch is approximately 8.7 times the conductor outer diameter ϕa. The twisting pitch may be not less than 6.2 times and not greater than 15.7 times, and more preferably not less than 8.7 times and not greater than 14.8 times the conductor outer diameter ϕa.

Figure 11:
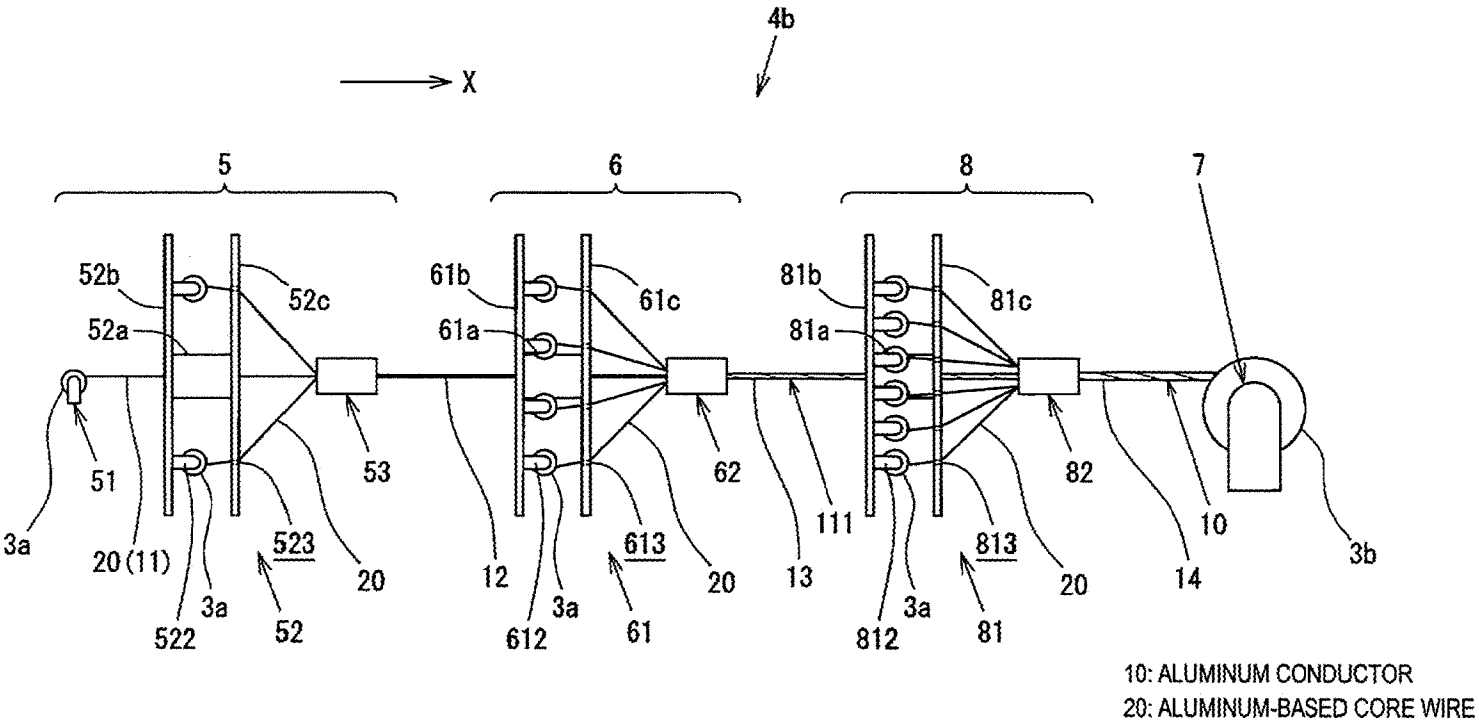
FIG. 11 is an explanatory view of a twisted wire conductor constituted of 37 soft core wires.

As illustrated in FIG. 11, the twisting machine 4*b* which twists the aluminum conductor 10 is constructed by disposing a second-layer twisting unit 5, a third-layer twisting unit 6, a fourth-layer twisting unit 8 which twists the fourth layer 14, and a conductor reeling part 7, in that order along the advancement direction X.

The fourth-layer twisting unit 8 is constituted of a fourth-layer twisting member 81 and a fourth-layer bunching chuck 82. Note that the fourth-layer twisting member 81 and the fourth-layer bunching chuck 82 have the same constructions as the second-layer twisting member 52 and the second-layer bunching chuck 53 of the second-layer twisting unit 5, and thus they are not illustrated in the draqings and are described in a simple manner below.

The fourth-layer twisting member 81 is constructed by integrating an axial core 81*a*, a first flange 81*b*, and a second flange 81*c*, and also has a rotation mechanism which is not illustrated in the drawings.

The axial core 81*a* is formed in a round cylindrical form having a through-hole which penetrates to the inner part along the advancement direction X.

The first flange 81*b* has 18 fourth bobbin attachment portions 812, and the second flange 81*c* forms 18 insertion holes 813.

These fourth bobbin attachment portions 812 and insertion holes 813 are disposed at mutually opposing positions so as to form a substantially regular hexagonal form as seen from the advancement direction X. The fourth bobbin attachment portions 812 and insertion holes 813 are provided two by two at equal spacing between the vertices.

The rotation mechanism provided on the fourth-layer twisting member 81 is provided on the axial core 81*a* and has the same construction as the rotation mechanism provided on the above second-layer twisting member 52.

Note that the rotation mechanism is not limited to being provided on the axial core 81*a*, similar to the rotation mechanism provided on the second-layer twisting member 52.

The fourth-layer bunching chuck 82 is formed in a round cylindrical form having an inner diameter equal to the diameter of the aluminum conductor 10, that is, the outer diameter of the fourth layer 14, and bunches the 18 aluminum-based core wires 20 that passed through the insertion holes 813 around the inner layer part 111 that passed through the through-hole.

A method for manufacturing an aluminum conductor 10 using the twisting machine 4*c* constructed as above will be described below.

Figure 12:
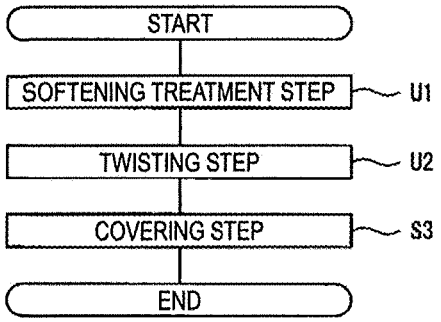
FIG. 12 is a flowchart for describing a method for manufacturing a twisted wire conductor constituted of 37 soft core wires.

As illustrated in FIG. 12, the aluminum conductor 10 is manufactured by performing a softening treatment step (step U1) and then performing a twisting step (step U2).

The softening treatment step (step U1) in the method for manufacturing the aluminum conductor 10 is the same as the softening treatment step (step S1) in the method for manufacturing the above aluminum conductor 10A, and a description thereof is therefore omitted.

In the twisting step (step U2), first, each of the bobbins 3*a* around which aluminum-based core wire 20 that has undergone softening treatment has been wound is attached to the first bobbin attachment portion 51, the second bobbin attachment portion 522, the third bobbin attachment portion 612, and the fourth bobbin attachment portion 812.

The tips of each of the aluminum-based core wires 20 unwound from the bobbins 3*a* attached to the bobbin attachment portions are fixed to a bobbin 3*b* attached to the conductor reeling part 7 in a state where they have been bundled by passing through a predetermined location.

When fixing of the aluminum-based core wires 20 to the bobbin 3*b* is complete, the first bobbin attachment portion 51, second bobbin attachment portion 522, third bobbin attachment portion 612, fourth bobbin attachment portion 812, and conductor reeling part 7 are made to rotate while the second-layer twisting member 52, third-layer twisting member 61, and fourth-layer twisting member 81 are made to revolve in the same direction.

Here, the rotation speeds of the first bobbin attachment portion 51, second bobbin attachment portion 522, third bobbin attachment portion 612, and fourth bobbin attachment portion 812 are controlled in accordance with the rotation speed of the conductor reeling part 7 to exert a tensile force of 10.6 N on each of the aluminum-based core wires 20 being twisted.

Note that the tensile force exerted on the aluminum-based core wires 20 is not limited to 10.6 N, and may be set as appropriate within a range of not less than 5.3 N and not greater than 23.85 N, preferably not less than 7.95 and not greater than 13.25 N (tensile force per unit cross-sectional area of not less than 12.5 $N/mm^2$ and not greater than 56.3 $N/mm^2$, preferably not less than 18.8 $N/mm^2$ and not greater than 31.3 $N/mm^2$).

Additionally, the revolution speeds of the second-layer twisting member 52, third-layer twisting member 61, and fourth-layer twisting member 81 are controlled in accordance with the rotation speed of the conductor reeling part 7 to twist the aluminum-based core wires 20 at a twisting pitch Pa of 31.7 mm, which is approximately 8.7 times the conductor outer diameter ϕa.

Note that in the present embodiment, due to the revolution speeds of the second-layer twisting member 52, third-layer twisting member 61, and fourth-layer twisting member 81 being the same speed, the twisting pitch of the second through fourth layers is the same.

The twisting step (step U2) described above is performed until the aluminum conductor 10 reaches the desired length.

Finally, the covering step (step S3) is performed, wherein the outer periphery of the aluminum conductor 10 manufactured in the twisting step (step U2) is covered with the insulating resin covering 30, to manufacture an aluminum electrical wire 1. Note that the covering step (step S3) is the same as the covering step (step S3) in the method for manufacturing the above aluminum conductor 10A, and a description thereof is therefore omitted.

As described above, it is possible to construct a desired aluminum conductor 10 that suppresses problems such as the aluminum-based core wires 20 being twisted in a disorderly manner and the aluminum-based core wires 20 jutting out to the exterior, by constructing it by disposing one aluminum-based core wire 20 as a center core wire 11 and concentrically disposing and twisting 6, 12, and 18 aluminum-based core wires 20 in order from the center core wire 11, and by setting the twisting pitch to approximately 8.7 times, which is not less than 6.2 times and not greater than 15.7 times the conductor outer diameter ϕa.

Note that because the twisting pitch is not less than 8.7 times and not greater than 14.8 times the conductor outer diameter ϕa, it is possible to construct a desired aluminum conductor 10 that reliably prevents problems such as the aluminum-based core wires 20 being twisted in a disorderly manner and the aluminum-based core wires 20 jutting out to the exterior.

Furthermore, in the above embodiment, the fourth layer 14 is continuously twisted relative to the inner layer part 111, but, for example, the fourth layer 14 may also be twisted relative to the inner layer part 111 after the inner layer part has been twisted.

Note that in this case, the tensile force per unit cross-sectional area exerted on the inner layer part 111 is to be not less than 250.0 N/mm$^2$ and not greater than 1875.0 N/mm$^2$.

Furthermore, by exerting a tensile force of 10.6 N, which is not less than 5.3 and not greater than 23.85 N, preferably not less than 7.95 and not greater than 13.25 N (tensile force per unit cross-sectional area of not less than 12.5 N/mm$^2$ and not greater than 56.3 N/mm$^2$, preferably not less than 8.8 and not greater than 31.3 N) on the aluminum-based core wires 20 in the twisting step, the aluminum-based core wires 20 can be twisted at a predetermined twisting pitch without slack. This makes it possible to manufacture a desired aluminum conductor 10 that prevents problems such as the aluminum-based core wires 20 being twisted in a disorderly manner and the aluminum-based core wires 20 jutting out to the exterior.

As a result, in addition to the above effects, by setting the tensile force exerted on the inner layer part 111 to a tensile force per unit cross-sectional area of not less than 250.0 N/mm$^2$ and not greater than 1875.0 N/mm$^2$, the aluminum-based core wires 20 that constitute the fourth layer 14 can be twisted at a predetermined twisting pitch without slack, even when a fourth layer 14 constituted of 18 aluminum-based core wires 20 is twisted on the outer side of an inner layer part 111 constituted of 19 aluminum-based core wires 20. This makes it possible to manufacture a desired aluminum conductor 10 that prevents problems such as the aluminum-based core wires 20 being twisted in a disorderly manner and the aluminum-based core wires 20 jutting out to the exterior.

Specifically, when twisted while exerting a tensile force of less than 250 N/mm$^2$ on the inner layer part 111 or without exerting a tensile force on the inner layer part 111, there is a possibility that slack will occur in the inner layer part 111.

On the other hand, when twisted while exerting a tensile force of greater than 1875.0 N/mm$^2$ on the inner layer part 111, there is a possibility that the aluminum-based core wires 20 will elongate and break.

In the above example, the manufacture of aluminum electrical wire 1 of size 8 sq was described, but an aluminum electrical wire 1A of a size not less than 2.5 and not greater than 16 sq, for example, may be manufactured by appropriately adjusting the tensile force per unit cross-sectional area during manufacture within a range of not less than 12.5 N/mm$^2$ and not greater than 56.3 N/mm$^2$ per unit cross-sectional area.

Note that when manufacturing the aluminum conductor 10, 10A by twisting the aluminum-based core wires 20, 20A using the twisting machine 4*b*, 4*a* as described above, it is unnecessary to perform the twisting step twice as there is with known rope stranding, and the equipment can be simplified, the manufacturing process can be simplified, quality can be improved, and manufacturing costs can be reduced.

The configurations of aluminum electrical wires 1 produced with different tensile forces and including the sizes described above in the above method are shown in Table 1.

TABLE 1

| | Conductor | | | | Finished | | |
|---|---|---|---|---|---|---|---|
| | Configuration | | Outer | Insulator | outer | Electrical | Thickness |
| Size | Number of strands | Core wire diameter (mm) | diameter (mm) | Thickness (mm) | diameter (mm) | wire mass (g/m) | deviation (%) |
| 2.5 | 19 | 0.45 | 2.10 | 0.40 | 2.80 | 13.2 | 74 |
| 5 | 19 | 0.56 | 2.80 | 0.40 | 3.60 | 19.0 | 76 |
| 8 | 19 | 0.73 | 3.65 | 0.40 | 4.45 | 30.0 | 80 |
| 10 | 19 | 0.82 | 4.10 | 0.60 | 5.30 | 41.0 | 81 |
| 12 | 19 | 0.91 | 4.55 | 0.60 | 5.75 | 48.9 | 82 |
| 16 | 19 | 1.06 | 5.30 | 0.65 | 6.60 | 65.1 | 81 |

Similarly, the aluminum electrical wire 1A can also be constructed with the sizes shown in Table 2 below as well as the above sizes.

TABLE 2

| | Conductor | | | | Finished | | |
|---|---|---|---|---|---|---|---|
| | Configuration | | Outer | Insulator | outer | Electrical | Thickness |
| Size | Number of strands | Core wire diameter (mm) | diameter (mm) | Thickness (mm) | diameter (mm) | wire mass (g/m) | deviation (%) |
| 2.5 | 37 | 0.32 | 2.24 | 0.40 | 3.04 | 12.9 | 72 |
| 5 | 37 | 0.40 | 2.80 | 0.40 | 3.60 | 18.6 | 75 |
| 8 | 37 | 0.52 | 3.64 | 0.40 | 4.44 | 29.3 | 78 |
| 10 | 37 | 0.59 | 4.13 | 0.60 | 5.33 | 40.8 | 79 |
| 12 | 37 | 0.65 | 4.55 | 0.60 | 5.75 | 48.0 | 80 |
| 16 | 37 | 0.76 | 5.32 | 0.65 | 6.62 | 64.3 | 79 |

Note that the thickness deviation of the aluminum electrical wire 1 in Table 1 and the aluminum electrical wire 1A in Table 2 is the ratio of thin locations relative to thick locations of the insulating resin covering 30, as previously described. Specifically, 20 aluminum electrical wires 1, 1A of a predetermined length are produced, and on lines that are extensions of the conductor outer diameter of the aluminum conductor 10, 10A on a randomly selected cross-section relative to the length direction, the thicknesses of the thick locations and thin locations of the insulating resin covering 30 are measured, and the ratio thereof is calculated.

TABLE 3

| | Conductor | | | | Finished | | |
|---|---|---|---|---|---|---|---|
| | Configuration | | Outer | Insulator | outer | Electrical | Thickness |
| Size | Number of strands | Core wire diameter (mm) | diameter (mm) | Thickness (mm) | diameter (mm) | wire mass (g/m) | deviation (%) |
| 2.5 | 41 | 0.32 | 2.40 | 0.60 | 3.60 | 37.5 | 45 |
| 5 | 65 | 0.32 | 3.00 | 0.70 | 4.40 | 58.2 | 50 |
| 8 | 50 | 0.45 | 3.70 | 0.80 | 5.30 | 84.7 | 52 |
| 10 | 63 | 0.45 | 4.50 | 1.00 | 6.50 | 114.3 | 53 |

TABLE 4

| | Conductor | | | | Finished | | |
|---|---|---|---|---|---|---|---|
| | Configuration | | Outer | Insulator | outer | Electrical | Thickness |
| Size | Number of strands | Core wire diameter (mm) | diameter (mm) | Thickness (mm) | diameter (mm) | wire mass (g/m) | deviation (%) |
| 2.5 | 37 | 0.32 | 2.25 | 0.40 | 3.05 | 12.8 | 40 |
| 5 | 58 | 0.32 | 2.80 | 0.80 | 4.40 | 25.5 | 45 |

First, the aluminum electrical wire 1, 1A (see Table 1, Table 2) will be compared with a bunch-stranded aluminum wire used in the related art (see Table 4).

For example, a 5 sq aluminum electrical wire 1 and a bunch-stranded aluminum electrical wire have equal conductor outer diameters of 2.80 mm, but the thickness deviation of the aluminum electrical wire 1, 1A is 76%, 75%, whereas the thickness deviation of the bunch-stranded aluminum electrical wire is 45%.

Since the thickness deviation of the 5 sq bunch-stranded aluminum electrical wire is lower than that of the aluminum electrical wire 1, the insulating resin covering 30 needs to be thicker (thickness 0.80 mm) in order to sufficiently protect the aluminum conductor. Thus, the finished outer diameter of the 5 sq bunch-stranded aluminum electrical wire is 4.40 mm, which is larger than the finished outer diameter of the aluminum electrical wire 1 (3.60 mm).

In contrast, because the thickness deviation of the aluminum electrical wire 1 can be larger, the thickness of the insulating resin covering can be thinner. As a result, an aluminum electrical wire having a smaller finished outer diameter than a bunch-stranded aluminum electrical wire of the related art can be manufactured.

Furthermore, the 5 sq aluminum electrical wire 1 (see Table 1) will be compared with a 3 sq copper wire (see Table 3). The 5 sq aluminum electrical wire 1 and the 3 sq copper wire are constructed with the same finished outer diameter of 3.60 mm. The electrical resistance of the 5 sq aluminum electrical wire 1 is 6.76 mΩ/m, whereas that of the 3 sq copper wire is 5.59 mΩ/m.

Additionally, when a 16 sq aluminum electrical wire 1 (see Table 1) is compared with a 10 sq copper wire (see Table 3), the finished outer diameters of the 16 sq aluminum electrical wire 1 and the 10 sq copper wire are around 6.5 mm, and the electrical resistance values are 1.91 mΩ/m and 1.84 mΩ/m, respectively.

In this way, because the aluminum electrical wire 1 can be manufactured to have the same finished diameter as the copper wire and the difference in electrical resistance between the aluminum electrical wire 1 and the corresponding copper wire is not greater than 20%, the above aluminum electrical wire 1 can be practically used instead of copper wire.

Furthermore, the mass per unit of an 8 sq aluminum electrical wire 1, 1A is about 30 g/m, whereas the mass of a corresponding 5 sq copper wire is 58.2 g/m. Thus, mass can be reduced by using the aluminum electrical wire.

As described above, the aluminum electrical wire 1, 1A shown in Tables 1 and 2 is constructed such that an aluminum conductor 10, 10A constituted of 37 or 19 aluminum-based core wires 20, 20A containing not less than 99 mass % of aluminum is covered with an insulating resin covering 30, wherein the aluminum conductor 10, 10A is constructed by concentrically twisting the aluminum-based core wires 20, 20A in a non-compressed state and at the same pitch, and the thickness deviation of the insulating resin covering 30 is not less than 70%. This makes it possible to construct the aluminum electrical wire 1, 1A so as to have electrical conductivity similar to that of a copper electrical wire 100 having a copper conductor 110 made of copper without an increase in electrical wire outer diameter.

Specifically, in an aluminum electrical wire 1, 1A wherein an aluminum conductor 10, 10A including 37 or 19 aluminum-based core wires 20, 20A is covered with an insulating resin covering 30, by constructing the aluminum conductor 10, 10A by concentrically twisting the aluminum-based core wires 20, 20A in a non-compressed state and at the same pitch, the aluminum conductor 10, 10A has excellent flexibility, and an aluminum conductor 10, 10A in which lightweight aluminum-based core wires 20, 20A are aligned in an orderly manner in cross-section without unraveling can be constructed.

Specifically, in the case of, for example, a twisted wire conductor in which core wires are twisted by a twisting method such as bunch stranding or rope stranding, although the electrical wire outer diameter is not large because the aluminum conductor 10, 10A is covered with an insulating resin covering 30 that is thin relative to the conductor outer diameter of the aluminum conductor 10, 10A, there is a possibility that unraveled core wires will jam into the insulating resin covering, and the insulating resin covering will deviate in thickness and localized portions of the insulating resin covering will become thin, and the performance required in an insulating resin covering 30 such as insulating properties and strength cannot be assured.

In contrast, in an aluminum conductor 10, 10A constructed by concentrically twisting aluminum-based core wires 20, 20A in a non-compressed state as described above, the required thickness can be reliably assured even with a thin insulating resin covering 30 because they are aligned in an orderly manner in cross-section.

Furthermore, by constructing an aluminum conductor 10, 10A with 19 or 37 concentrically twisted aluminum-based core wires 20, 20A, an aluminum electrical wire 1, 1A including a conductor constructed by a twisting method suitable for a desired cross-sectional area can be constructed. Furthermore, because the 19 or 37 aluminum-based core wires constituting the aluminum conductor 10, 10A are concentrically twisted, electrical conductivity between aluminum-based core wires can be assured.

Note that bending performance of the aluminum conductor 10, 10A can be assured due to the aluminum-based core wires 20, 20A being in a non-compressed state. Specifically, in the case where the aluminum-based core wires 20, 20A have been compressed, the rigidity of the aluminum conductor 10, 10A is high and desired bending performance is not obtained, but bending performance can be assured by putting the aluminum-based core wires 20, 20A in a non-compressed state.

Additionally, by constructing the aluminum conductor 10, 10A with aluminum-based core wires 20, 20A, the mass of the aluminum electrical wire 1, 1A can be reduced.

Specifically, because the aluminum-based core wires 20 that constitute the aluminum electrical wire 1, 1A have a lighter specific gravity than the copper core wires 120 that constitute the copper conductor 110, the total cross-sectional area of the aluminum-based core wires 20, 20A can be made larger and the mass of the aluminum electrical wire 1, 1A can be made lighter (see Tables 1, 2, and 3).

Furthermore, because the thickness deviation of the aluminum electrical wire 1, 1A is not less than 70%, that is, because there is no non-uniformity in the thickness of the insulating resin covering 30 of the aluminum electrical wire 1, 1A, the aluminum conductor 10, 10A can be protected by the insulating resin covering 30 and the cross-sectional shape of the aluminum electrical wire 1, 1A can be close to a perfect circle even for an aluminum electrical wire 1, 1A having a desired outer diameter.

Additionally, due to the fact that the aluminum-based core wires 20, 20A constituting the aluminum conductor 10, 10A are disposed in a cross-sectionally hexagonal form, the aluminum-based core wires 20, 20A constituting the aluminum conductor 10, 10A can be aligned in a more orderly manner in cross-section and the cross-sectional shape of the aluminum conductor 10, 10A can be made stable across the length direction. As a result, the thickness of the insulating resin covering 30 can be substantially identical on average and a required thickness can be reliably assured even with a thin insulating resin covering 30.

Furthermore, as a mode of the present invention, by using the same core wire diameter for the 19 or 37 aluminum-based core wires 20, 20A constituting the aluminum conductor 10, 10A, the aluminum conductor 10, 10A can be formed of one aluminum-based core wire 20, 20A. Thus, error in the inner diameter of the aluminum conductor 10, 10A can be reduced. Additionally, because there is no need to manufacture a plurality of types of aluminum-based core wire 20, 20A, the manufacturing process can be simplified and manufacturing costs can be reduced.

Furthermore, because the aluminum-based core wires 20, 20A constituting the aluminum conductor are disposed in a cross-sectionally regular hexagonal form, they can be more stably disposed because the aluminum-based core wires 20, 20A disposed on the outer layer can fit between the aluminum-based core wires 20, 20A disposed on the inner layer. Specifically, the aluminum conductor 10, 10A can be aligned in a more orderly manner. Additionally, because they are concentrically twisted at the same pitch, the aluminum-based core wires 20, 20A can be prevented from unraveling.

As a mode of the present invention, by setting the cross-sectional area of the aluminum conductor 10, 10A to not less than 2.5 $mm^2$ and less than 17 $mm^2$, an aluminum electrical wire 1, 1A having a desired electrical conductivity can be constructed without an increase in wire outer diameter.

Specifically, because the electrical conductivity of the aluminum-based core wires 20, 20A is lower than that of copper-based core wires of the same diameter, it is difficult to assure similar electrical conductivity with an outer diameter similar to that of a copper-based electrical wire constituted of copper-based core wires when the cross-sectional area of the aluminum conductor 10, 10A constituted of 37 or 19 aluminum-based core wires 20, 20A is less than 2.5 $mm^2$.

Conversely, when the cross-sectional area of the aluminum conductor 10, 10A constituted of 37 or 19 aluminum-based core wires 20, 20A is not less than 17 $mm^2$, although electrical conductivity similar to that of a copper-based electrical wire can be assured, there is a possibility that rigidity of the aluminum conductor 10, 10A will be high, flexibility will be lost, and the bending performance of the electrical wire evaluated by, for example, a flexing test or the like, will decrease.

Furthermore, by setting the thickness of the insulating resin covering 30 to a thickness of less than 10% and not greater than 20% of the conductor outer diameter $\phi a$, $\phi b$, an aluminum electrical wire 1, 1A can be constructed without an increase in electrical wire outer diameter.

For example, when the thickness of the insulating resin covering 30 is less than 10%, there is a possibility that the required performance such as insulating properties and strength of the insulating resin covering 30 cannot be satisfied.

Conversely, when the thickness of the insulating resin covering 30 is greater than 20% of the conductor outer diameter, there is a possibility that the electrical wire outer diameter will be larger than that of a copper electrical wire of similar electrical conductivity. In contrast, because the thickness of the insulating resin covering 30 is not less than 10% and not greater than 20% of the conductor outer diameter, an aluminum electrical wire 1, 1A having a desired electrical conductivity can be constructed without an increase in electrical wire outer diameter.

Additionally, with an aluminum conductor 10, 10A constituted of 37 or 19 aluminum-based core wires 20, 20A, the conductor outer diameter of the aluminum conductor 10, 10A is larger than that of a copper conductor 110 constituted of copper core wires 120 having similar electrical conductivity, but because the aluminum-based core wires 20, 20A are constituted of aluminum-based material which is flexible and contains not less than 99 mass % of aluminum, the aluminum-based core wires themselves have an appropriate degree of flexibility and can form aluminum electrical wires 1, 1A having suitable flexibility.

Furthermore, when the aluminum electrical wire 1, 1A is, for example, crimp-connected by a crimping portion of a crimping terminal, it can be properly connected by crimping at a crimping rate, for example, from 40 to 80% (more preferably from 40 to 70%) without the crimping portion being damaged.

Specifically, when an aluminum conductor 10, 10A is constructed by twisting aluminum-based core wires containing less than 99 mass % of aluminum, because the hardness of the aluminum-based core wires increases, there is a possibility of the crimping portion of the crimping terminal being damaged when the aluminum conductor constituted of the aluminum-based core wires is crimped at a predetermined crimping rate. However, by using an aluminum conductor 10, 10A constituted of aluminum-based core wires 20, 20A containing not less than 99 mass % of aluminum of low hardness, the aluminum conductor 10, 10A can be properly connected by crimping without the crimping portion of the crimping terminal being damaged.

Furthermore, by setting the thickness of the insulating resin covering 30 to not less than 7% and less than 14% of the electrical wire outer diameter, an aluminum electrical wire 1, 1A in which the lowest thickness of insulating resin covering 30 is assured can be constructed.

Additionally, the insulating resin covering 30 has a tensile strength at 23° C. of not less than 19 MPa, a heat deformation rate of not greater than 25%, a cold tolerance of not higher than −20° C., and a volume resistivity at 30° C. of not less than $3\times10^{12}$ Ω·cm. As a result, an aluminum electrical wire 1, 1A that satisfies the required performance of an insulating resin covering 30 can be constructed without a decrease in mechanical strength of the insulating resin covering 30 and without an increase in electrical wire outer diameter.

Furthermore, due to the fact that the cross-sectional area of the aluminum conductor 10, 10A is set to not less than 5 $mm^2$ and the thickness of the insulating resin covering 30 is set to not greater than 15% of the conductor outer diameter of the aluminum conductor 10, 10A, an aluminum electrical wire 1, 1A which has an electrical conductivity similar to that of a copper electrical wire 100 having a copper conductor 110 made of copper, and in which a required thickness can be reliably assured even when the insulating resin covering 30 is thin, can be constructed by the aluminum conductor 10, 10A constituted by concentrically twisted aluminum-based core wires 20, 20A without an increase in electrical wire outer diameter.

Additionally, by constructing an aluminum conductor 10 with 37 concentrically twisted aluminum-based core wires 20 or an aluminum conductor 10A with 19 concentrically twisted aluminum-based core wires 20A, an aluminum electrical wire 1, 1A comprising an aluminum conductor 10, 10A constructed by a twisting method suitable for a desired cross-sectional area can be constructed.

In the correspondence between the construction of the present invention and the above embodiment, the conductor of the present invention corresponds to the aluminum conductor 10, 10A, but the invention is not intended to be limited to the construction in the aforementioned embodiment, and many other embodiments can also be employed.

REFERENCE SIGNS LIST

1, 1A Aluminum electrical wire
10, 10A Aluminum conductor
20, 20A Aluminum-based core wire
30 Insulating resin covering

The invention claimed is:

1. An aluminum electrical wire, comprising:

a conductor comprising a plurality of aluminum-based core wires; and an insulating resin covering directly covering the conductor such that the insulating resin covering is in contact with the plurality of aluminum-based core wires and has a thickness deviation of not less than 70%, wherein the plurality of aluminum-based core wires contains 99 mass % of aluminum, and the conductor is constructed by concentrically twisting 19 or 37 of the aluminum-based core wires at a same pitch in a non-compressed state such that the aluminum electrical wire has a current capacity that is substantially same as a current capacity of a copper electrical wire having a diameter that is substantially same as a diameter of the aluminum electrical wire.

2. The aluminum electrical wire according to claim 1, wherein the aluminum-based core wires are positioned in a cross-sectionally regular hexagonal form.

3. The aluminum electrical wire according to claim 2, wherein the 19 or 37 aluminum-based core wires have core wire diameters that are identical.

4. The aluminum electrical wire according to claim 2, wherein the conductor has a cross-sectional area that is not less than 2.5 $mm^2$ and less than 17 $mm^2$.

5. The aluminum electrical wire according to claim 2, wherein the insulating resin covering has a thickness of not less than 10% and not greater than 20% of an outer diameter of the conductor.

6. The aluminum electrical wire according to claim 2, wherein the insulating resin covering is made of vinyl chloride resin.

7. The aluminum electrical wire according to claim 2, wherein the conductor is constructed by concentrically twisting 19 of the aluminum-based core wires, and the twisting pitch is set not less than 6.4 times and not greater than 22.0 times an outer diameter of the conductor.

8. The aluminum electrical wire according to claim 2, wherein the conductor is constructed by concentrically twisting 37 of the aluminum-based core wires, and the twisting pitch is set not less than 6.2 times and not greater than 15.7 times an outer diameter of the conductor.

9. The aluminum electrical wire according to claim 1, wherein the 19 or 37 aluminum-based core wires have core wire diameters that are identical.

10. The aluminum electrical wire according to claim 9, wherein the conductor is constructed by concentrically twisting 19 of the aluminum-based core wires, and the twisting pitch is set not less than 6.4 times and not greater than 22.0 times an outer diameter of the conductor.

11. The aluminum electrical wire according to claim 9, wherein the conductor is constructed by concentrically twisting 37 of the aluminum-based core wires, and the twisting pitch is set not less than 6.2 times and not greater than 15.7 times an outer diameter of the conductor.

12. The aluminum electrical wire according to claim 1, wherein the conductor has a cross-sectional area that is not less than 2.5 $mm^2$ and less than 17 $mm^2$.

13. The aluminum electrical wire according to claim 1, wherein the insulating resin covering has a thickness of not less than 10% and not greater than 20% of an outer diameter of the conductor.

14. The aluminum electrical wire according to claim 1, wherein the insulating resin covering is made of vinyl chloride resin.

15. The aluminum electrical wire according to claim 1, wherein the conductor is constructed by concentrically twisting 19 of the aluminum-based core wires, and the twisting pitch is set not less than 6.4 times and not greater than 22.0 times an outer diameter of the conductor.

16. The aluminum electrical wire according to claim 1, wherein the conductor is constructed by concentrically twisting 37 of the aluminum-based core wires, and the twisting pitch is set not less than 6.2 times and not greater than 15.7 times an outer diameter of the conductor.

17. The aluminum electrical wire according to claim 1, wherein the conductor has a cross-sectional area that is not less than 5.0 $mm^2$ and less than 17 $mm^2$.

18. A method for manufacturing an aluminum electrical wire, comprising:

constructing a conductor by twisting a plurality of aluminum-based core wires; and directly covering the conductor with an insulating resin covering such that the insulating resin covering is in contact with the plurality of aluminum-based core wires and has a thickness deviation of not less than 70%, wherein the plurality of aluminum-based core wires contains 99 mass % of aluminum, and the conductor is constructed by concentrically twisting 19 or 37 of the aluminum-based core wires at a same pitch in a non-compressed state such that the aluminum electrical wire has a current capacity that is substantially same as a current capacity of a copper electrical wire having a diameter that is substantially same as a diameter of the aluminum electrical wire.

19. The method for manufacturing an aluminum electrical wire according to claim 18, further comprising:

applying a softening treatment on the aluminum-based core wires prior to the constructing of the conductor.

20. The method for manufacturing an aluminum electrical wire according to claim 18, further comprising:

applying a softening treatment on the aluminum-based core wires between the constructing of the conductor and the covering of the conductor.

* * * * *